US011834916B2

(12) United States Patent
Correa et al.

(10) Patent No.: US 11,834,916 B2
(45) Date of Patent: Dec. 5, 2023

(54) SHEAR COUPLING FOR SUCKER ROD STRING

(71) Applicant: Harbison-Fischer, Inc., Crowley, TX (US)

(72) Inventors: Felipe Correa, Fort Worth, TX (US); Ramamurthy Narasimhan, Bangalore (IN); Sergio Granados, Mansfield, TX (US); Sean Terrill, Crowley, TX (US)

(73) Assignee: HARBISON-FISCHER, INC., Crowley, TX (US)

( * ) Notice: Subject to any disclaimer, the term of this patent is extended or adjusted under 35 U.S.C. 154(b) by 19 days.

(21) Appl. No.: 17/550,221

(22) Filed: Dec. 14, 2021

(65) Prior Publication Data

US 2022/0282579 A1 Sep. 8, 2022

Related U.S. Application Data

(60) Provisional application No. 63/156,835, filed on Mar. 4, 2021.

(51) Int. Cl.
*E21B 17/06* (2006.01)
*E21B 17/042* (2006.01)
*E21B 17/046* (2006.01)

(52) U.S. Cl.
CPC ..... *E21B 17/06* (2013.01); *E21B 17/046* (2013.01); *E21B 17/0426* (2013.01)

(58) Field of Classification Search
CPC ..... E21B 17/046; E21B 17/0426; E21B 17/06
See application file for complete search history.

(56) References Cited

U.S. PATENT DOCUMENTS 3,329,450 A * 7/1967 Current ..... E21B 33/1204 411/548
4,411,546 A * 10/1983 Fischer ..... E21B 47/007 403/2

(Continued)

FOREIGN PATENT DOCUMENTS

KR 1020100059330 6/2010

OTHER PUBLICATIONS

International Written Opinion for PCT/US2021/063349, dated Apr. 11, 2022, 6 pages.

(Continued)

*Primary Examiner* — D. Andrews
(74) *Attorney, Agent, or Firm* — PCFB LLC

(57) ABSTRACT

The present disclosure relates, according to some embodiments, to a shear pin including a cylindrical shape positioned along a vertical axis having a first end having a common diameter with a second end; the first end and containing a first clutch at a point along the vertical axis that is furthest from the second end, the first clutch containing one of a recessing shape and a protruding shape; (c) the second end containing a second clutch at a point along the vertical axis that is furthest from the first end, the second clutch containing one of a recessing shape and a protruding shape; and (d) the curved portion including a diameter that is largest where the curved portion connects to each of the first end and the second end and then narrows along the curved portion, forming a curve that culminates at a neck where the diameter is smallest.

21 Claims, 14 Drawing Sheets

(56) References Cited

U.S. PATENT DOCUMENTS

| | | | | |
|---|---|---|---|---|
| 4,459,060 | A * | 7/1984 | Patterson | F04B 53/144 403/2 |
| 2009/0271966 | A1* | 11/2009 | Fotty | E21B 17/06 29/428 |
| 2011/0150596 | A1 | 6/2011 | Wolodko et al. | |
| 2015/0030374 | A1 | 1/2015 | Lea-Wilson et al. | |
| 2015/0368989 | A1 | 12/2015 | Lauder et al. | |
| 2017/0356252 | A1 | 12/2017 | Wollmann et al. | |

OTHER PUBLICATIONS

International Search Report for PCT/US2021/063349, dated Apr. 11, 2022, 4 pages.

* cited by examiner 810
802
820
804

802
820
800
820
820
804

802
820

804
820

SHEAR COUPLING FOR SUCKER ROD STRING

CROSS-REFERENCE SECTION

This application claims priority to U.S. Provisional Application No. 63/156,835, filed on Mar. 4, 2021, which is incorporated by reference herein in its entirety for all purposes.

FIELD OF THE DISCLOSURE

The present disclosure relates, in some embodiments, to shear couplings in downhole or subsurface oil pumping strings ("sucker rod strings") to provide a specific, controlled point of failure to protect the other elements of the sucker rod string from damage, including in sucker rod pumping systems.

BACKGROUND OF THE DISCLOSURE

Upon completion of drilling an oil well, fluids from the oil well may be under sufficient innate or natural pressure to allow the oil well to produce on its own. Therefore, crude oil in such wells can rise to the well surface without any assistance. But, even though an oil well can initially produce on its own, natural pressure generally declines as the well ages. In many oil wells, therefore, fluids are artificially lifted to the surface with downhole or subsurface pumps. Sucker rod pump systems are commonly used systems to transport these fluids from downhole oil-bearing zones to the well surface to be collected, refined, and used for various applications.

Typical sucker rod pump systems have a plunger that reciprocates inside a barrel while attached at the end of a string of sucker rods. A prime mover, such as a gasoline or diesel engine, or an electric motor, or a gas engine, on the surface causes a pump jack to rock back and forth, thereby moving the string of sucker rods up and down inside of the well tubing.

Either because of wear or other environmental factors, when the string sucker rods encounters resistance to movement, one or more elements within the string can become damaged/overstressed. When that happens, it often results in rupture of expensive equipment and downtime, as it may be required to extract the entire rod string out of the ground for repair. And this repair time also causes expensive downtime from production.

It is known to use a shear coupling in sucker rod systems, where the shear coupling provides a controlled and predictable point of failure, including in a rotating sucker rod pump where the rod string is regularly rotated about the axis of the longitudinal pumping motion in order to make the wear more uniform. Without using a shear coupling or shear pin of some type, with all the pieces of a sucker rod string being independently designed to their maximum strength, the point of failure is unpredictable, making recovery from a failure event even more difficult.

SUMMARY OF THE EMBODIMENTS

Disclosed are embodiments of shear couplings that provide improved performance characteristics over prior art approaches. In particular, it is desired to have a shear coupling that ruptures within its design tolerance. If it fails to rupture when intended, then it risks damage to the other elements of the rod string assembly, longer and costlier workover jobs, and a potential environmental hazard by the spillage of well fluids while pulling tubing out of the well. If it ruptures too easily, it causes needless downtime under a stress condition that would not have been a danger to the remainder of the rod string assembly. It is further desired to have a rod string that has an extended fatigue life provided its working load is not exceeded. It is still further desired that the shear couplings have stable threaded connections so that they remain securely engaged.

Disclosed embodiments of the present application include a shear pin configured to threadably connect within a shear coupling and to provide a point of failure for a sucker rod string, the shear pin including (a) a cylindrical shape positioned along a vertical axis having a first end positioned at a top of the vertical axis and a second end positioned at a bottom of the vertical axis and having a curved portion connecting the first end to the second end. The shear pin may include (b) the first end having a common diameter with the second end and containing: (i) a set of first threads on an outer circumference of the first end, the set of first threads having a first handedness and configured to threadably connect within the shear coupling; and (ii) a first clutch at a point along the vertical axis that is furthest from the second end, the first clutch containing one of a recessing shape and a protruding shape. The shear pin may include (c) the second end that may contain (i) a set of second threads on an outer circumference of the second end, the set of second threads having an opposite handedness from the set of first threads and configured to threadably connect within the shear coupling; and (ii) a second clutch at a point along the vertical axis that is furthest from the first end, the second clutch containing one of a recessing shape and a protruding shape. The shear pin may contain (d) a curved portion including a diameter that is largest where the curved portion connects to each of the first end and the second end and then narrows along the curved portion, forming a curve that culminates at a neck where the diameter is smallest.

In some embodiments, the present disclosure relates to a shear pin configured to threadably connect within a shear coupling and to provide a point of failure for a sucker rod string. The shear pin may include a cylindrical shape positioned along a vertical axis having a first end positioned at a top of the vertical axis and a second end positioned at a bottom of the vertical axis and having a curved portion connecting the first end to the second end. The shear pin may include the first end having a common diameter with the second end and containing (i) a set of first threads on an outer circumference of the first end, the set of first threads having a first handedness and configured to threadably connect within the shear coupling; and (ii) a first clutch at a point along the vertical axis that is furthest from the second end, the first clutch containing one of a recessing shape and a protruding shape. The second end may include a set of second threads on an outer circumference of the second end, the set of second threads having an opposite handedness from the set of first threads and configured to threadably connect within the shear coupling. The curved portion may include a diameter that is largest where the curved portion connects to each of the first end and the second end and then narrows along the curved portion, forming a curve that culminates at a neck where the diameter is smallest. The ratio of a curvature radius of the curve to the diameter of the neck ranges from about 2 to about 10.

The present disclosure relates to a shear coupling configured to provide a point of failure for a sucker rod string, the shear coupling including a first sleeve containing a substantially cylindrical and hollow body, the first sleeve further containing a first sleeve upper end containing threads around an inner circumference of the first sleeve upper end, the first sleeve configured to internally receive and threadably couple to a sucker rod. The first sleeve may also contain a first sleeve lower end connected to the first sleeve upper end through a first sleeve body, the first sleeve lower end containing threads around an inner circumference of the second sleeve lower end that are separated from the threads of the first sleeve upper end by a gap and configured to internally receive and threadably couple to a shear pin. The shear pin may include a cylindrical shape positioned along a vertical axis having a first end positioned at a top of the vertical axis and a second end positioned at a bottom of the vertical axis and having a curved portion connecting the first end to the second end, the first end having a common diameter with the second end and including a set of first threads on an outer circumference of the first end, the set of first threads having a first handedness and configured to threadably connect within the shear coupling, and a first clutch at a point along the vertical axis that is furthest from the second end, the first clutch containing one of a recessing shape and a protruding shape. The shear pin may include the second end that contains a set of second threads on an outer circumference of the second end, the set of second threads having an opposite handedness from the set of first threads and configured to threadably connect within the shear coupling, and a second clutch at a point along the vertical axis that is furthest from the first end, the second clutch containing one of a recessing shape and a protruding shape. The shear pin may include the curved portion containing a diameter that is largest where the curved portion connects to each of the first end and the second end and then narrows along the curved portion, forming a curve that culminates at a neck where the diameter is smallest.

A shear coupling may include a second sleeve containing a substantially cylindrical and hollow body, the second sleeve further including a second sleeve lower end comprising threads around an inner circumference of the second sleeve lower end, the second sleeve configured to internally receive and threadably couple to a sucker rod, and a second sleeve upper end connected to the second sleeve lower end through a second sleeve body, the second sleeve upper end comprising threads around an inner circumference of the second sleeve upper end that are separated from the threads of the second sleeve lower end by a gap and configured to internally receive and threadably couple to the shear pin. The shear coupling may include a chamber located in between an inner surface of each of the hollow bodies of the first sleeve and the second sleeve and an outer surface of the shear pin, wherein the hollow chamber is filled with one of an epoxy, a corrosive resistant thermoset single polymer, and a corrosive resistant thermoset cross linked polymer.

A shear coupling may include a first sleeve lower end and a first sleeve upper end. The first sleeve lower end may include teeth at a point along a vertical axis that is furthest from the first sleeve upper end and extending away from the first sleeve upper end and the second sleeve upper end further may include teeth at a point along the vertical axis that is furthest from the second sleeve lower end and extending away from the second sleeve lower end. The teeth of the first sleeve lower end are configured to engage the teeth of the second sleeve upper end and the secure the first sleeve and the second sleeve from relative rotational movement, wherein the teeth are further configured to provide for a rupture torque of the shear coupling that ranges from about 500 foot-pounds to about 5000 foot-pounds. The first sleeve lower end may include a protruding hex locking engagement at a point along the vertical axis that is furthest from the first sleeve upper end and extending out of the first sleeve lower end in a direction away from the first sleeve upper end, wherein the second sleeve upper end further comprises a recessing hex locking engagement at a point along the vertical axis that is furthest away from the second sleeve lower end and recessing into the second sleeve upper end in a direction towards the second sleeve lower end, and wherein the protruding hex locking engagement and the recessing hex locking engagement secure the first sleeve and the second sleeve from relative rotational movement. The first sleeve lower end may include a recessing hex locking engagement at a point along the vertical axis that is furthest from the first sleeve upper end and recessing into the first sleeve lower end in a direction towards the first sleeve upper end, where the second sleeve upper end further comprises a protruding hex locking engagement at a point along the vertical axis that is furthest away from the second sleeve lower end and protruding away from the second sleeve lower end in a direction away from the second sleeve lower end. In some embodiments, the recessing hex locking engagement and the protruding hex locking engagement secure the first sleeve and the second sleeve from relative rotational movement.

A shear pin may include a ratio of a curvature radius of the curve to the diameter of the neck ranges from about 2 to about 10. The shear pin may have a diameter of the neck ranging from about 0.25 inches to about 1.25 inches. The shear pin may have a stress safety factor of lower than 1.10. A shear pin may have a rupture load ranging from about 5,000 pounds to about 70,000 pounds. The shear pin may have a first clutch or a second clutch, where each of the first clutch and second clutch may have a recessing shape or a protruding shape. The recessing shape of the first clutch contains one of a triangular-shaped cross-section, a cross-shaped cross-section, a three-arm-shaped cross-section, a hex-shaped cross-section, a star-shaped cross-section, a square-shaped cross-section, and a polygon-shaped cross-section. The protruding shape of the first clutch contains one of a triangular-shaped cross-section, a cross-shaped cross-section, a three-arm-shaped cross-section, a hex-shaped cross-section, a star-shaped cross-section, a square-shaped cross-section, and a polygon-shaped cross-section. The recessing shape of the second clutch contains one of a triangular-shaped cross-section, a cross-shaped cross-section, a three-arm-shaped cross-section, a hex-shaped cross-section, a star-shaped cross-section, a square-shaped cross-section, and a polygon shaped-cross-section. The protruding shape of the second clutch contains one of a triangular-shaped cross-section, a cross-shaped cross-section, a three-arm-shaped cross-section, a hex-shaped cross-section, a star-shaped cross-section, a square-shaped cross-section, and a polygon-shaped cross-section. A first clutch may have a protruding shape while a second clutch may have a protruding shape. The first clutch may have a recessing shape while the second clutch may have a protruding shape. The first clutch may have a protruding shape while the second clutch may have a recessing shape. The first clutch may have a recessing shape while the second clutch may have a recessing shape.

In some embodiments, the present disclosure relates to a method for assembling a shear coupling configured to provide a point of failure for a sucker rod string, the method including securing a first sleeve to a first non-rotating shaft by passing the first non-rotating shaft through a hollow body of the first sleeve until a first mechanical coupler of the first non-rotating shaft is exposed through an end of the first sleeve. The method may also include securing a second sleeve to a second non-rotating shaft by passing the second non-rotating shaft through a hollow body of the second sleeve until a second mechanical coupler of the second non-rotating shaft is exposed through an end of the second sleeve, wherein the first sleeve, the first non-rotating shaft, the second sleeve, and the second rotating shaft are all aligned along a horizontal axis. The method may include coupling a first end of a shear pin to the first mechanical coupler of the first non-rotating shaft, wherein the first end of the shear pin comprises a set of first threads on an outer circumference of the first end, and wherein the first threads have a first handedness configured to threadably connect within the shear coupling. The method may include coupling a second end of the shear pin to the second mechanical coupler of the second non-rotating shaft, wherein the second end of the shear pin comprises a set of second threads on an outer circumference of the second end having an opposite handedness from the set of first threads and configured to threadably connect within the shear coupling. The method may include applying a thread locker on a surface of each of the set of first threads and set of second threads and rotating the first sleeve about the horizontal axis so that the first set of threads is threaded inside the first sleeve while rotating the second sleeve about the horizontal axis so that the second set of threads is threaded inside the second sleeve until the first sleeve and the second sleeve meet at a center point along a horizontal axis of the shear pin, thereby forming an assembled shear coupling. The method may include engaging teeth of the first sleeve with teeth of the second sleeve, thereby securing the first sleeve and the second sleeve from relative rotational movement, wherein the teeth on each of the first sleeve and the second sleeve are oriented toward each other.

A method for assembling a shear coupling may include positioning a wrench on a flat on each of the first sleeve and a second sleeve; adjusting an orientation of a head on the wrench until a bar of the wrench is aligned with the horizontal axis; and applying a first low preload torque of about 10% to about 20% of a shear pin yield stress strength on the bar of the wrench until the wrench makes a clicking sound. The method for assembling the shear coupling may include releasing the first torque on the bar without removing the wrench; applying a second preload torque of about 70% of the shear pin yield stress strength on the bar of the wrench; and removing the shear coupling from each of the first non-rotating shaft and the second non-rotating shaft. In some embodiments, the first sleeve and the second sleeve each comprise a perforation on each of their respective ends that are oriented toward each other. The shear coupling may include a hollow chamber located in between an inner surface of each of the hollow bodies of the first sleeve and the second sleeve and an outer surface of the shear pin. The method for assembling the shear coupling may include applying a polymer to at least one perforation of the first sleeve and the second sleeve, thereby filling the hollow chamber to form a polymer filled chamber comprising the applied polymer, wherein the polymer comprises an epoxy, a corrosive resistant thermoset single polymer, and a corrosive resistant thermoset cross linked polymer.

DETAILED DESCRIPTION

Figure 1:
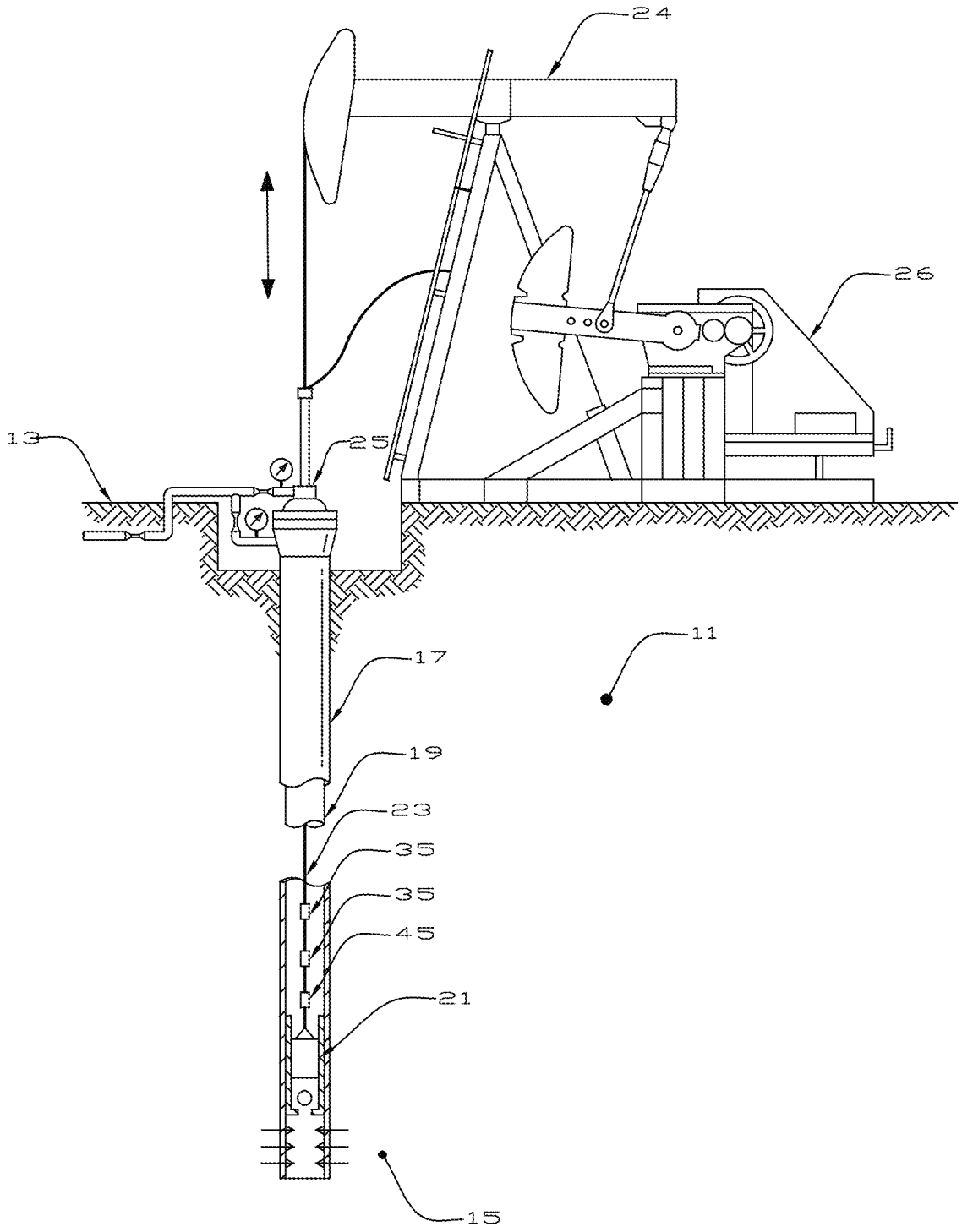
FIG. 1 shows an overall, environmental view of a sucker rod pumping well installation.

FIG. 1 illustrates a general sucker rod pumping system for a producing oil well 11. The well has a borehole that extends from the surface 13 into the earth, past an oil-bearing formation 15. The borehole has a casing 17, which is perforated at the formation 15. Tubing 19 extends inside of the casing from the formation to the surface 13.

A subsurface pump 21 is located in the tubing 19 at or near the formation 15. A string 23 of sucker rods extends from the pump 21 up inside of the tubing 19 to a polished rod and a stuffing box 25 on the surface 13. The sucker rod string 23 is connected to a pump jack unit, or beam pump unit 24, which reciprocates up and down due to a prime mover 26, such as an electric motor or gasoline or diesel engine, or gas engine. The sucker rod string 23 typically consists of a series of fixed-length straight rods joined together by couplings 35. The sucker rod string may as well comprise a continuous metal or fiber-glass string running uninterrupted from the surface 13 down to a depth near that of the pump, and including other elements such as guides, sinker-bars, or pony-rods, among others.

The rod string may include one or multiple shear-couplings 45 to provide a known point of failure to protect surface and downhole assets in the event of overstresses during the operation or handling of the sucker rod string 23/pump 21 assembly. The shear coupling is typically installed at the bottom of the sucker rod string (nearest to the pump 21); additionally, there may sometimes be a shear coupling placed at the top of the sucker rod string (farthest from the pump) or at another locations dependent upon design needs.

Shear couplings may be utilized in other forms of artificial lift (not shown in FIG. 1) such as in progressive cavity systems, in which the drive rods rotate transmitting torque from a surface unit to a downhole screw-type pump. In progressive cavity application the drive-rods fulfill an analogue function to that of the sucker rods in a sucker-rod pump; that is, transmitting mechanical power via rotation or reciprocation from a surface driving unit to a subsurface pump.

The nature and magnitude of the stresses overseen by the rod string in a progressive cavity application, however, differs from those in a rod pumping application; while axial stresses induced by the weight of the hydrostatic column of fluid above the pump may be similar in magnitude in both, shear stress from torque transmission exclusively impacts progressive cavity applications.

Figure 2A:
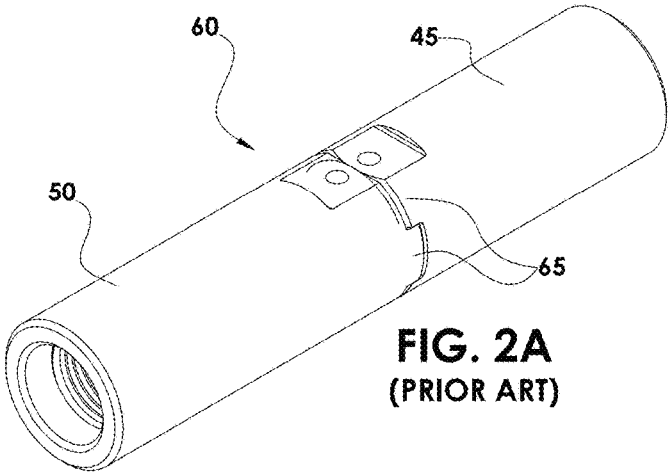
FIG. 2A (PRIOR ART)
FIG. 2A shows a perspective view of a prior art shear coupling.
Figure 2B:
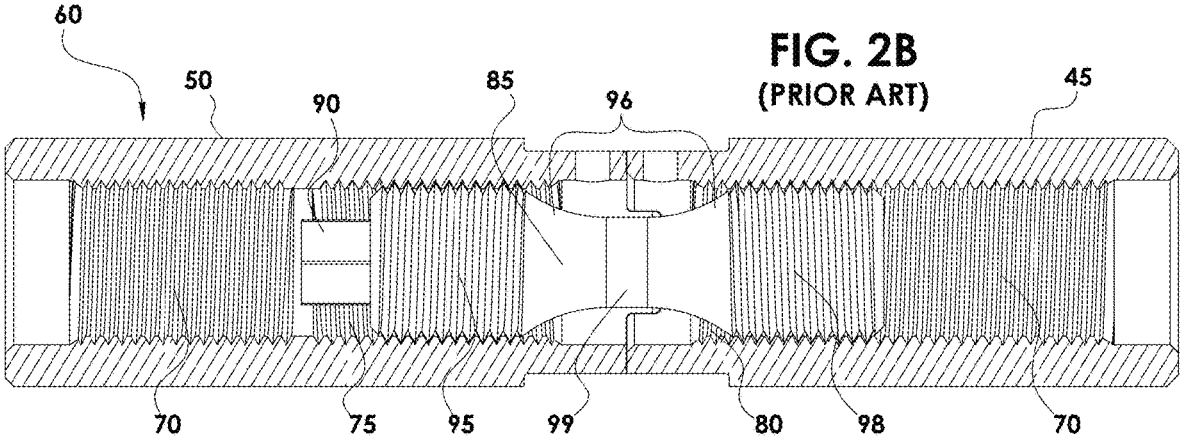
FIG. 2B (PRIOR ART)
FIG. 2B shows a cross sectional view of a prior art shear coupling.

Hereafter, the term rod string alludes to both types of artificial lift systems; reciprocating rod-pumping systems as well as rotational progressive cavity applications. Furthermore, the rod string, including shear couplings or any other subcomponent, are presumed to be simultaneously under axial and torsional load. FIG. 2A-2B illustrate in more detail a typical prior art shear coupling 60. The shear coupling 60 has first and second sleeves 50,45 and mating teeth 65 that engage and work to secure the first and second sleeves 50,45 from relative movement, including rotationally, when the first and second sleeves 50,45 are screwed together by relative rotation of the shear pin 85.

FIG. 2B shows a cross-sectional view of the prior art shear coupling 60, and particularly shows that the first and second sleeves each include threads 70 for connecting to the joining ends of the rod string (not shown). In other words, the shear coupling 60 is used as a coupling between sucker rods above and below it in the rod string 23 by engaging with those rods using the threads 70 as a normal rod string coupling would do. Further shown in FIG. 2B are opposite-direction ("handedness") threaded connections 75,80, which are used to pull together the first and the second sleeves by the rotation of the shear pin 85 using the clutch 90. In the prior art, a wrench would be used to turn the shear pin 85 relative to the two sleeves 50,45, which are fixed rotationally. This in turn pulls both sleeves toward each other by virtue of the opposite threads 75,80 of the first and second sleeves 50,45. As can be seen in the cross-section, the prior art has a "dog bone" section or curved portion 96 between its threaded ends 95,98. This dog bone portion 96 is the portion of the shear pin 45 that is designed to fail under axial pulling at a predictable load. Specifically, the indicated stress failure area 99 is the portion where the shear pin has its smallest diameter and where the failure is designed to occur to protect the sucker rod string 23 and other surface and downhole assets from damage in the event of an over-stress event. The intentional and controlled disconnection of the rod-string from the pump by actuating the shear-coupling requires a counteracting force in the same magnitude as the set rupture load of the shear-coupling, which is only possible in the event the pump becomes stuck downhole. Under normal circumstances either during operation or during a well intervention, the pulling load exerted on the rod-string is considerably lower than the rupture load on the shear coupling, preventing its actuation.

Figure 3A:
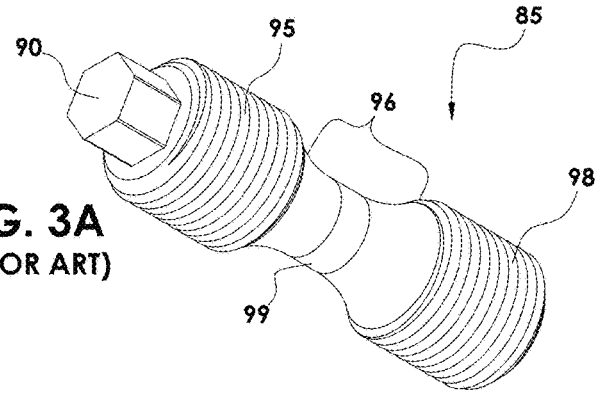
FIG. 3A (PRIOR ART)
FIG. 3A illustrates a perspective view of a prior art shear pin.
Figure 3B:
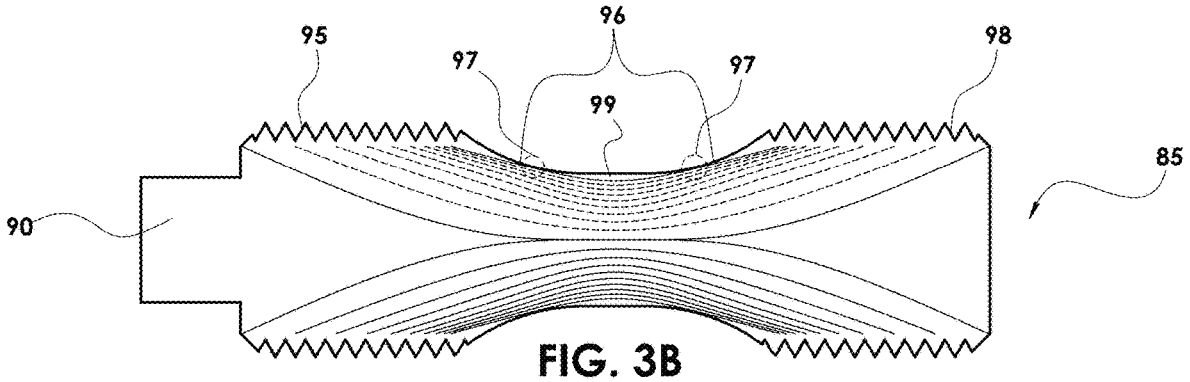
FIG. 3B (PRIOR ART)
FIG. 3B illustrates a cross-sectional view of a prior art shear pin showing lines of stress within the shear pin.
Figure 4A:
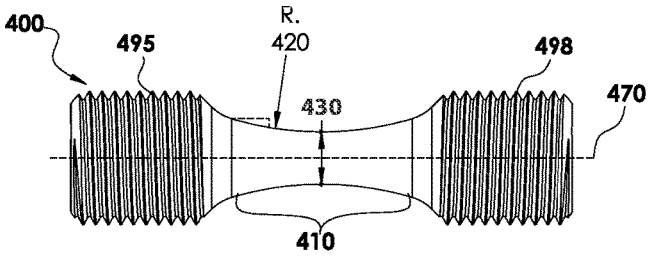
FIG. 4A illustrates a side plan view of a shear pin in accordance with embodiments of the present specification.

When a pump becomes stuck downhole, the actuation of the shear coupling allows the workover crew to pull the rods and the tubing separately in a considerably faster and safer manner, reducing the cost and the risk to the operators intrinsically associated with the pulling job. Furthermore, given the tubing may be abnormally charged with well fluids, the actuation of the shear coupling facilitates the containment of the said fluids in the surface preventing a potential spillage at the wellhead. The actuation of the shear-coupling is a last resource action aimed at protecting company assets, minimizing downtime, and preventing a potential oil spillage at the well. FIG. 3A illustrates a perspective view of the prior art shear pin 85 in standing by itself and not mounted into the left and right sleeves 50,45. As described above, the narrowest part (smallest diameter) of the dog bone section 96 is marked as an indicated area 99 where the designed rupture of the shear coupling is set to occur. And FIG. 3B illustrates stress flow lines in an exemplary prior art device. Areas of the illustration where the flow lines appear "packed" 97 qualitatively correlate with higher stress concentration factors 97. As observed in figures FIG. 3B, the regions of highest concentration of stress are located outside of the target rupture area 99, which is undesirable as it negatively impacts the predictability of the rupture load. FIG. 4A illustrates a present embodiment shear pin 400 configured to threadably connect within a shear coupling and to provide a point of failure for a sucker rod string. The present embodiment improves upon the predictability of the designed failure load and the endurance to metal fatigue during operation as will be further described in the description of the embodiments below. The shear pin 400 includes an improved dog bone area 410 or curved portion 410. The shear pin includes a cylindrical shape positioned along a vertical axis having a first end positioned at a top of the vertical axis and a second end positioned at a bottom of the vertical axis and having a curved portion 410 connecting the first end to the second end. The first end may have a common diameter with the second end. The curved portion 410 includes a diameter "D" that is largest where the curved portion 410 connects to each of the first end and the second end and then narrows along the curved portion 410, forming a curve that culminates at a neck where the diameter is smallest. The curved portion 410 is further defined by the illustrated curvature radius "R" 420 and neck diameter "D" 430, where this neck is defined as the narrowest diameter of the curved portion 410. The curvature radius R sweeps seamlessly through section 410 along the longitudinal direction (parallel to the center axis 470). The shear pin 400 has radial symmetry about its center axis 470, and so this constant radius "R" will be perpendicular to every point along every longitudinal surface line within the stress-focus zone 440. Stated differently, at the intersection of each plane that contains both the center axis and the longitudinal line on the surface of the curved portion 410 of the shear pin 400, there is a line of radius R defined within that plane where the radius line lies within that plane and originates at a point above the bisection of the surface longitudinal line.

A shear pin may have a ratio of a curvature radius of the curve to the diameter of the neck that ranges from about 2 to about 10. A ratio of a curvature of radius of the curve to the diameter of the neck may be about 2, or about 3, or about 4, or about 5, or about 6, or about 7, or about 8, or about 9, or about 10, where about includes plus or minus 0.5. A shear pin may have a diameter of a neck that ranges from about 0.25 inches to about 1.25 inches. A shear pin may have a diameter of a neck of about 0.25 inches, or about 0.50 inches, or about 0.75 inches, or about 1.00 inch, or about 1.25 inches, where about includes plus or minus 0.125 inches. A shear pin may have a stress safety factor of lower than about 1.50. A shear pin may have a stress safety factor of lower than about 1.10. A shear pin may have a stress safety factor ranging from about 0.10 to about 1.50. A shear pin may have a stress safety factor of about 0.10, or about 0.20, or about 0.30, or about 0.40, or about 0.50, or about 0.60, or about 0.70, or about 0.80, or about 0.90, or about 1.00, or about 1.10, or about 1.20, or about 1.30, or about 1.40, or about 1.50, where about includes plus or minus 0.05. A shear pin may have a rupture load ranging from about 5,000 pounds to about 70,000 pounds. A shear pin may have a rupture load of about 5,000 pounds, or about 10,000 pounds, or about 15,000 pounds, or about 20,000 pounds, or about 25,000 pounds, or about 30,000 pounds, or about 35,000 pounds, or about 40,000 pounds, or about 45,000 pounds, or about 50,000 pounds, or about 55,000 pounds, or about 60,000 pounds, or about 65,000 pounds, or about 70,000 pounds, or about 75,000 pounds, where about includes plus or minus 2,500 pounds.

Figure 4B:
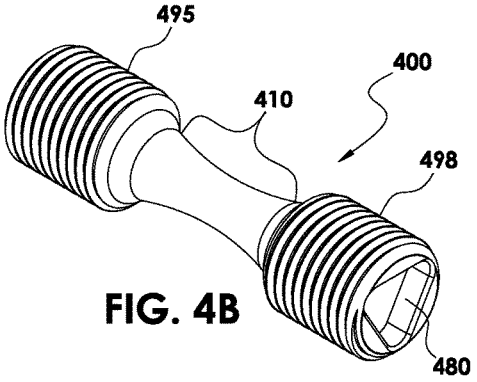
FIG. 4B illustrates a perspective view of a shear pin in accordance with embodiments of the present specification.

FIGS. 4A and 4B illustrates the threaded connections of the shear-pin. The opposite orientation of the threads on each end of the shear pin-allow for the engagement between the teeth and mounts on the two sleeves to take place, that is, allowing for the axial displacement of the sleeves during assembly, while preventing any relative rotation between the two. Disclosed embodiments incorporate threads with the same size and pitch on both ends for the purpose of maintaining symmetry during assembly as will be disclosed below. A shear pin may include a first end containing a set of first threads on an outer circumference of the first end and having a first handedness and configured to threadably connect within a shear coupling. The shear pin may include a second end containing a set of second threads on an outer circumference of the second end and having an opposite handedness from the set of first threads and configured to threadably connect within the shear coupling. A first end may include a first clutch at a point along a vertical axis that is furthest from a second end and including one of a recessing shape and a protruding shape. A second end may include a second clutch at a point along a vertical axis that is furthest from a first end, the second clutch containing one of a recessing shape and a protruding shape.

FIG. 4B illustrates those longitudinal lines 475 in perspective view, as well as showing a female clutch 480 at the end of the visible side (in this view) of the shear pin 400. An identically shaped clutch 480 is at the other end of the shear pin (not shown—see FIG. 4C).

Figure 4C:
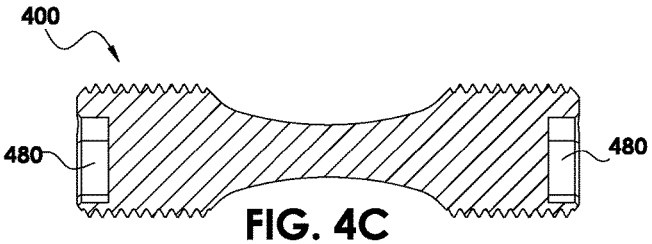
FIG. 4C illustrates a cross-sectional view of a shear pin in accordance with embodiments of the present specification.

FIG. 4C shows a cross-sectional view of the shear coupling embodiment of FIGS. 4A-4B. This cross-sectional view illustrates that the clutch 480 is provided at both sides of the shear pin. Use of a clutch at both ends provides for an improved fatigue characteristic by using two-sided shear coupling when mounting the shear pin into the first and second sleeves of the sheer coupling. (see FIG. 5 below).

As illustrated in the embodiment of FIGS. 4A-4C, a constant R is provided across the stress-focus area, although other embodiments are disclosed herein. In this constant-R embodiment, the shear coupling is designed so that the ratio between the curvature radius R and the neck diameter D at its narrowest point is at least 4 ($R/D \geq 4$) or in other embodiments the R/D is at least 5 ($R/D \geq 5$) or at least 6 ($R/D \geq 6$) according to specific embodiment design needs. According to this design, the center of the arc is located on the same plane or is coplanar to what will be the "rupture plane" at the neck.

The profiled neck of the curved portion 410 in embodiments disclosed herein is a smooth curve, either analytic or discrete, or a combination of both in a piecewise defined function. For analytic curves, the neck, or sections of it, may follow a polynomial curve of order 2 or higher, as well as other standard curves such as power, exponential, logarithmic, or trigonometric functions such as sine, cosine, or tangent. Likewise, linear or non-linear, implicit or explicit combinations of the aforementioned functions may be included, including hyperboles, ellipses, parabolas, or circles in which the ratio of the local radius of curvature R in the stress-focus region 440,550 to the neck diameter D is >=4.

Figure 5:
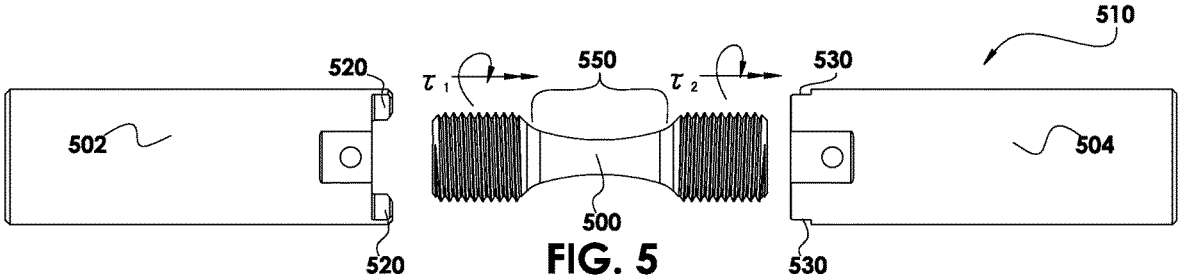
FIG. 5 is an exploded view of a shear coupling illustrating a first sleeve, a second sleeve, and a shear pin that will be engaged inside and coupling between the first and second sleeve.

FIG. 5 illustrates the use of a two-sided shear coupling for assembling a present embodiment shear pin 500 into first and second sleeves 502,504 to form a present embodiment sheer coupling 510 that minimizes assembly-induced localized stresses and accordingly makes for an assembled shear coupling 510 that has better distributed stresses in assembly and has improved fatigue characteristics. The torque ($\tau_1$ and $\tau_2$) is applied substantially equally to the clutches 480 at each end of the shear pin 500. This substantially equal torque is applied in the same direction as illustrated at the same time using a pair of wrenches (or analogous fixtures/tools) that are inserted through the open ends of the sleeves 502,504 that are distal from their proximal sides of engagement with the shear pin 500. By applying this torque to the clutches 480 while keeping the sleeves rotationally fixed but allowing the sleeves to move longitudinally along a coaxial path among the sleeves 502,504 and the shear pin 500, the sleeves 502 504 are pulled together until they engage and cover the entire radial surfaces of the shear pin. Although the radial surfaces of the shear pin 500 are now enclosed within the sleeves 502,504, the wrenches or analogous fixtures/tools remain engaged with the clutches 508 of the shear pin.

As the two sleeves 502,504 are brought into engagement, the teeth 520 of one sleeve are aligned with the corresponding mounts 530 in the other sleeve 504 preventing any relative rotational movement between the two sleeves 502, 504 around the coaxial axis between them, this allows a fully seated engagement between sleeves 502,504. At this time, the torque ($\tau_1$ and $\tau_2$) continues to be applied substantially equally to the clutches 480 at each end of the shear pin 500 to "pre-load" a tension on the engagement between the shear pin 500 and the sleeves 502,504. That pre-load amounts to a purely axial tensile stress that is applied and held between the sleeves 502,504 and the shear pin 500, and this pre-loaded tensile stress is distributed nearly evenly across the stress-focus region 550.

In some embodiments, a shear coupling 510 may be configured to provide a point of failure for a sucker rod string and may include a first sleeve 502 containing a substantially cylindrical and hollow body. A first sleeve 502 may include a first sleeve upper end and containing threads around an inner circumference of the first sleeve upper end, the first sleeve configured to internally receive and threadably couple to a sucker rod. A first sleeve 502 may include a first sleeve lower end connected to the first sleeve upper end through a first sleeve body, the first sleeve lower end containing threads around an inner circumference of the second sleeve lower end that are separated from the threads of the first sleeve upper end by a gap and configured to internally receive and threadably couple to the shear pin. A shear coupling may include a second sleeve containing a substantially cylindrical and hollow body, the second sleeve including a second sleeve lower end having threads around an inner circumference of the second sleeve lower and, the second sleeve configured to internally receive and threadably couple to a sucker rod. The second sleeve may include a second sleeve upper end connected to the second sleeve lower end through a second sleeve body, the second sleeve upper end may include threads around an inner circumference of the second sleeve upper end that are separated from the threads of the second sleeve lower end by a gap and configured to internally receive and threadably couple to the shear pin. A shear coupling may include a chamber located in between an inner surface of each of the hollow bodies of the first sleeve and the second sleeve and an outer surface of the shear pin, wherein the hollow chamber is filled with one of an epoxy, a corrosive resistant thermoset single polymer, and a corrosive resistant thermoset cross linked polymer.

In prior art implementations of shear pins where the "one-sided" assembly and pre-loading is performed by a clutch at a single side, those pre-load stresses are applied asymmetrically, which results in torque failures during the pre-loading assembly process. Further in the prior art, the asymmetry of pre-load stress can cause fatigue failures during operation outside of the originally intended shear pin rupturing parameters.

Figure 6A:
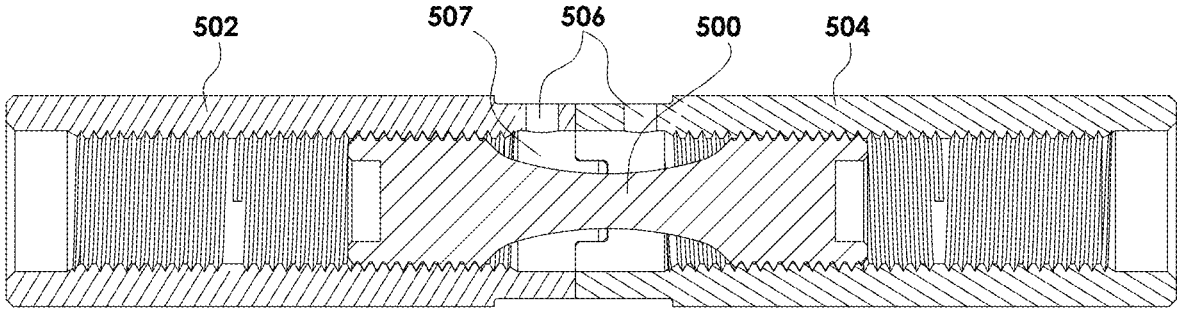
FIG. 6A illustrates a cross section view of a completed assembly of the first and second sleeves and the shear pin of FIG. 5.
Figure 6B:
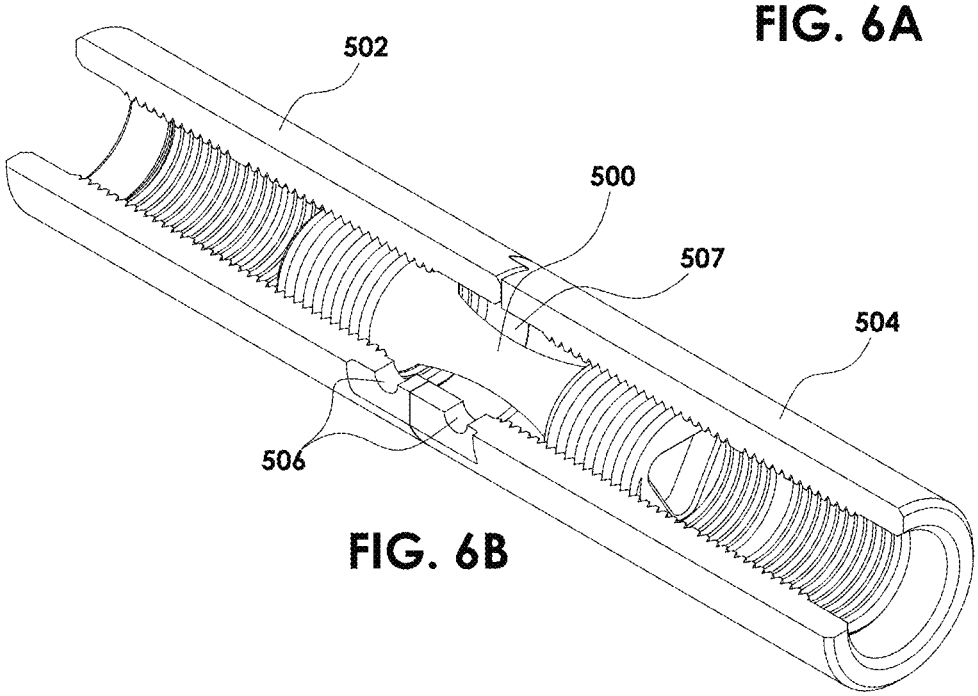
FIG. 6B is a perspective and sectioned view of the assembly of FIG. 6A.

FIG. 6A-6B illustrates a final assembly of the shear pin 500 within the first and second sleeves 502,504. In this assembly, using the above-described shear pin and assembly methods, the stress concentration is reduced to provide a stress concentration factor of lower than 1.10 or 1.05 in certain embodiments. The actual stress concentration factor varies within the provided range depending upon the specific ratio of the thread major diameter to the neck diameter in a particular embodiment, in which a larger ratio will yield a larger stress-concentration factor and the other way around. The engineering selection of the thread sizes and the material properties define the ratio between the thread and the neck diameter and in turn the stress concentration factor. The estimations for the stress concentration factor provided in here are based on theoretical correlations and a Finite Element Analysis of the shear pin.

The pre-load in assembled shear couplings is defined as a percentage of the design rupture load, and it can be up to 70% of the specific rupture load of a specific configuration. Since shear couplings are manufactured to different rupture loads, the assembly pre-load will vary accordingly following proprietary correlations, not to exceed 70% of the rupture load. For example, a shear coupling made to rupture at 21,000 lbs, may be pre-loaded up to 14,700 lbs during assembly, and a shear coupling made to rupture at 50,000 lbs may be pre-loaded up to 35,000 lbs. The target pre-load is calculated based on the rupture load. The rupture load as referred to in the context of shear-couplings corresponds to the maximum pure axial load the shear-pin may withstand under static conditions.

Note that the target pre-load needed to reach 70% of the rupture load of the shear-pin is not attainable unless the torque is applied symmetrically from both ends of the shear-pin, thereby exhibiting the synergy between the applied pre-load and the torque-balanced assembly method subject of the present disclosure. A one-sided or a highly asymmetrical application of the pre-load on the shear-pin will result in an unbalanced torque at the rupture neck of the pin, leading to a shear-pin failure should the shear-stress at the neck exceeds the maximum shear strength of the section. Even if the application of an asymmetrical torque does not yield to the immediate rupture of the shear-pin during assembly, it may still irreversibly damage the part by inducing micro-cracks in the neck of the shear pin, which will act as initiation points for fatigue cracks to propagate reducing the fatigue life of the assembly. As a reference, when torqued unilaterally, shear-pins as disclosed in the present disclosure rupture due to shear-stress upon reaching 60% of the axial design rupture load.

Thus, using the described embodiments and assembly techniques, an improved shear coupling is provided that can provide for increased pre-load, reducing alternating stress (Sa) during pump operation, and thereby increasing fatigue life of the shear coupling. Increasing the pre-load further strengthens the threaded connection of the shear pin into the first and second sleeves, making the threaded engagement between the shear pin and first and second sleeves less susceptible to backing off. Further, again because of the greater stress pre-load, the integrity of the assembly becomes less reliant on using a thread locker to keep the shear pin engaged in the sleeves. This is further advantageous because thread locker compounds can be prone to failure at high temperature operating conditions.

As further described, the improved stress-focus zone design provides a reduction in stress concentration and thereby reduces fatigue load and accordingly lessens stress fatigue, reducing fatigue-related failure. The stress concentration, and accordingly the safety factor, is increased by up to 24% relative to prior known designs not using the described RID ratio and constant curve approaches described herein.

As still further described above, the two-sided shear coupling and shear pin designs allow for a greatly reduced (to less than 1% or less) residual shear-stress after assembly and provides for a reduced or eliminated risk of induced cracks during assembly pre-loading of the shear coupling. Following are a number of additional embodiments, but the foregoing design advantages are applicable to all of these additional embodiments.

FIG. 6A-B further illustrate a couple of perforation 506 on the sleeves 502 and 504, located near the middle section of the assembled shear coupling and allowing access to an interior chamber 507, where the neck of the shear-pin 500 is located. In disclosed shear-couplings, the perforations 506 allow for the injection of a corrosion resistant epoxy or resin to fill in the chamber 507, thus preventing corrosive well fluids from filling the cavity and turning it into an electrochemical cell that will corrode the assembly from inside. Corrosion in general, but specifically pitting corrosion is known to drastically reduce the fatigue life of metal parts as it accelerates the creation of stress raiser points, which rapidly develop into cracks that eventually propagate and cause a premature failure.

FIGS. 7A-7D illustrate multiple plan views of a shear coupling embodiment 710 of the present specification. A shear coupling 710 may include a first sleeve lower end containing teeth 720 at a point along a vertical axis that is furthest from the first sleeve upper end and extending away from the first sleeve upper end. A shear coupling 710 may include a second sleeve upper end containing teeth 730 at a point along the vertical axis that is furthest from the second sleeve lower end and extending away from the second sleeve lower end. The teeth 710 of the first sleeve lower end may be configured to engage the teeth 730 of the second sleeve upper end and to secure the first sleeve and the second sleeve from relative rotational movement and may be configured to provide for a rupture torque of the shear coupling that ranges from about 500 foot-pounds to about 5,000 foot-pounds. A rupture torque may be about 500 foot-pounds, or about 1,000 foot-pounds, or about 1,500 foot-pounds, or about 2,000 foot-pounds, or about 2,500 foot-pounds, or about 3,000 foot-pounds, or about 3,500 foot-pounds, or about 4,000 foot-pounds, or about 4,500 foot-pounds, or about 5,000 foot-pounds, where about includes plus or minus 250 foot-pounds.

Figure 7A:
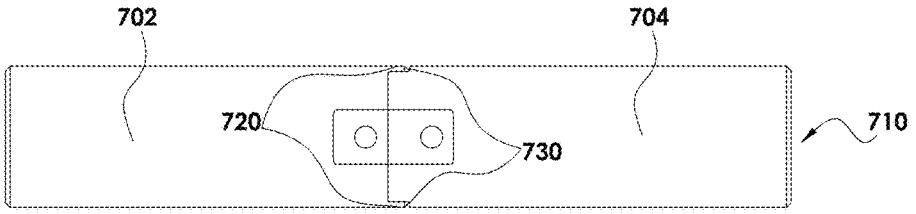
FIGS. 7A-7D illustrate multiple plan views of an shear coupling embodiment of the present specification.
Figure 7B:
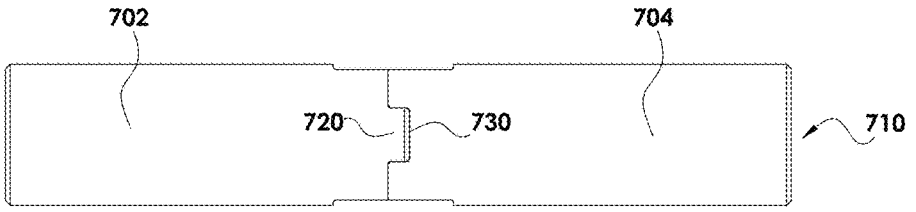
Figure 7C:
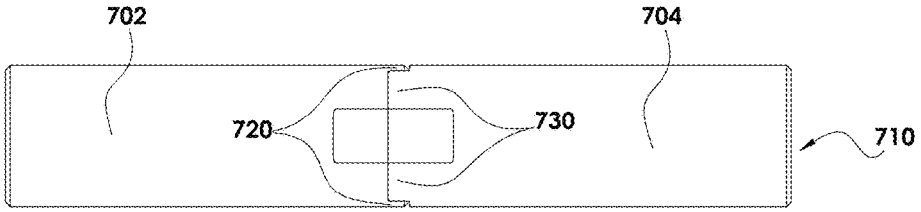
Figure 7D:
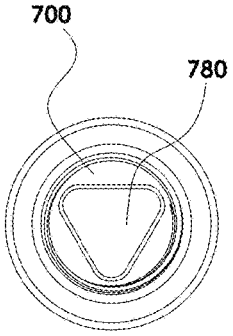

In this embodiment, there are provided two teeth 720 and the first sleeve 702 that engage with two mounts 730. The embodiment also illustrates a triangular female clutch 780, which while illustrated on one side of the shear pin 700 in FIG. 7D is also on the other side. Although in the embodiments illustrated in this specification there is provided a clutch of the same type and same gender on both sides of the shear pin, it should be appreciated that this is not necessary and a clutch of a different shape and/or gender can be provided on opposite sides of the shear pin according to design principles. The assembly of the shear pin would still preferably have a two-sided and substantially equal torque applied on both sides of the embodiment shear pins disclosed herein.

Figures 8A, 8B, 8C, 8D:
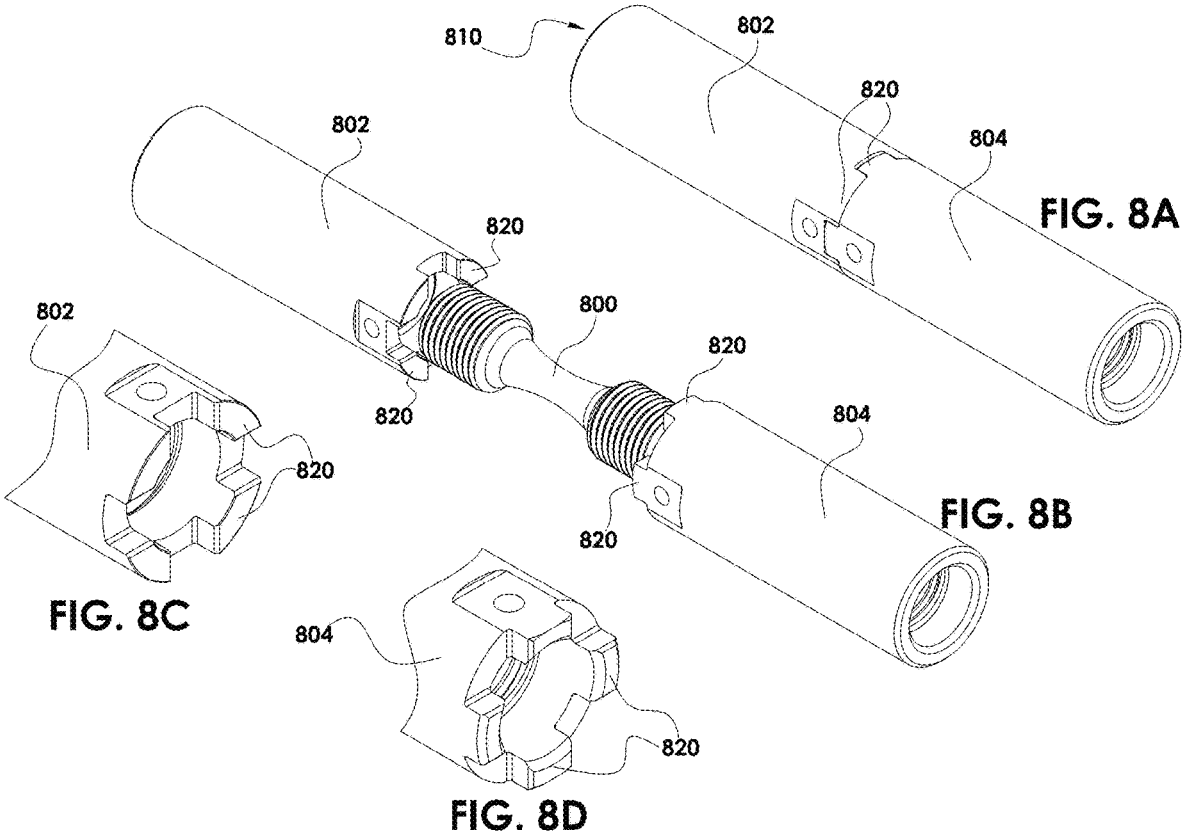
FIG. 8A is a perspective view of an embodiment shear coupling where the two engaging sleeves have four engaging teeth each, as contrasted to the two teeth each of the embodiments illustrated in FIGS. 5-7.
FIG. 8B is a perspective exploded view of the FIG. 8A embodiment.
FIGS. 8C-D are perspective views of the teethed ends of the respective first and second sleeves of the embodiment of FIG. 8A.

FIG. 8A is a perspective view of an embodiment shear coupling where the two engaging sleeves 802,804 each have four engaging teeth 820, as contrasted to the two teeth 720 of the embodiments illustrated in FIGS. 5-7. FIG. 8B is a perspective exploded view of the FIG. 8A embodiment showing the shear pin 800 that is assembled into the sleeves 802,804. FIGS. 8C-D are perspective views of the teethed ends 820 of the respective first and second sleeves 802,804 of the embodiment of FIG. 8A-B.

Figures 9A, 9B, 9C, 9D:
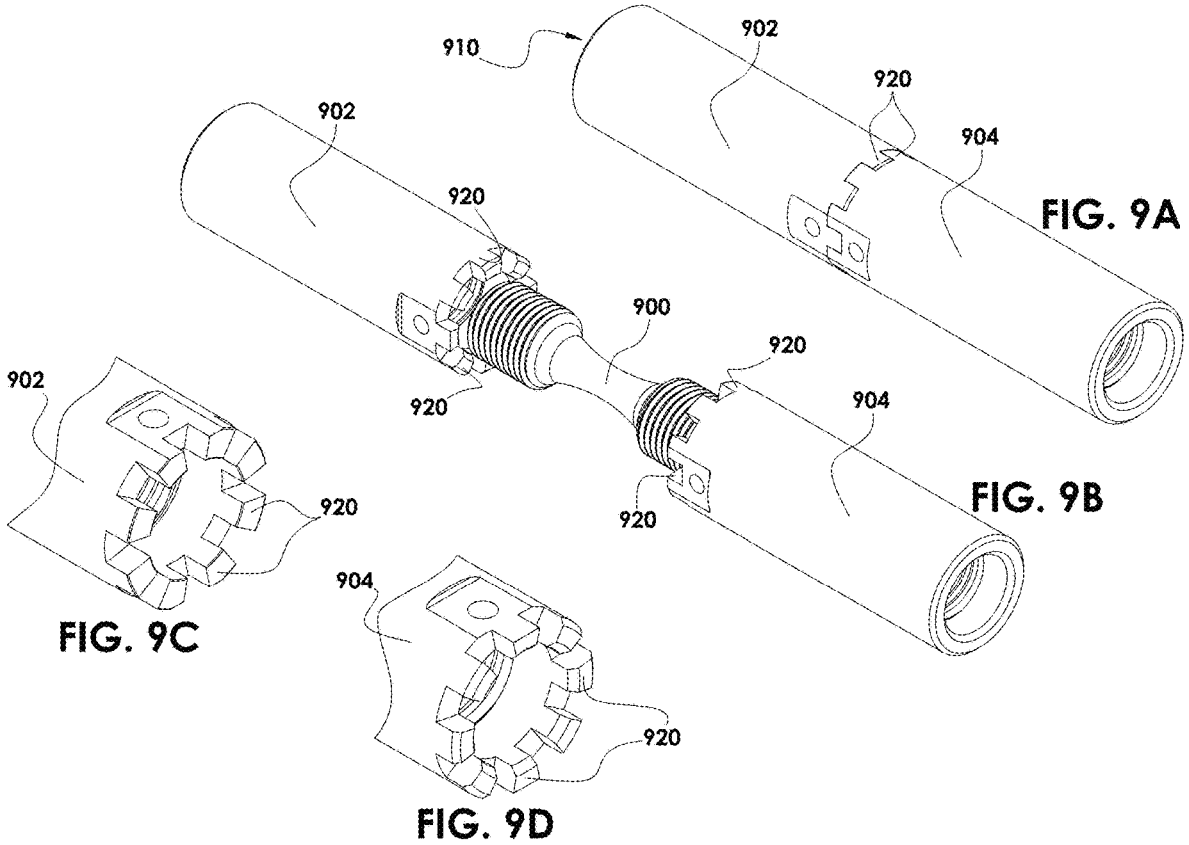
FIG. 9A is a perspective view of an embodiment shear coupling where the two engaging sleeves have multiple engaging straight teeth, symmetrically disposed and radially converging to the sleeve longitudinal axis.
FIG. 9B is a perspective exploded view of the FIG. 9A embodiment.
FIGS. 9C-D are perspective views of the teethed ends of the respective first and second sleeves of the embodiment of FIG. 9A.

FIG. 9A is a perspective view of an embodiment shear coupling where the two engaging sleeves 902,904 each have eight engaging teeth 920, as contrasted to the two teeth 720 of the embodiments illustrated in FIGS. 5-7 and the four teeth 820 of the embodiments illustrated in FIGS. 8A-8D. FIG. 9B is a perspective exploded view of the FIG. 8A embodiment showing the shear pin 900 that is assembled into the sleeves 902,904. FIGS. 9C-D are perspective views of the teethed ends 920 of the respective first and second sleeves 902,904 of the embodiment of FIG. 9A-B.

Figures 10A, 10B, 10C, 10D:
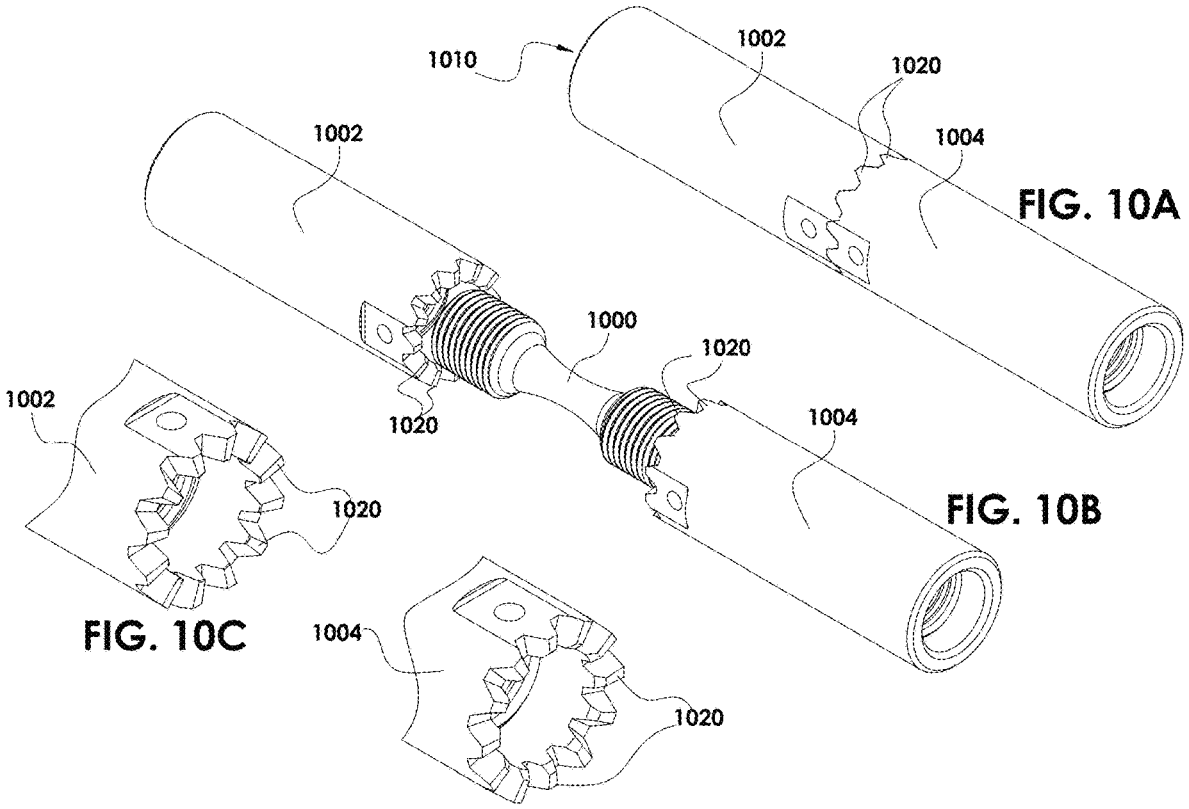
FIG. 10A is a perspective view of an embodiment shear coupling where the two engaging sleeves have multiple engaging tapered teeth, symmetrically disposed and radially converging to the sleeve longitudinal axis.
FIG. 10B is a perspective exploded view of the FIG. 10A embodiment.
FIGS. 10C-D are perspective views of the teethed ends of the respective first and second sleeves of the embodiment of FIG. 10A.

FIG. 10A is a perspective view of an embodiment shear coupling where the two engaging sleeves 1002, 1004 each have periodically cycling engaging teeth 1020 with sloped sides in a saw tooth pattern as contrasted to the more square-sided teeth described in the embodiments of FIGS. 3-9. An advantage of this saw tooth design is that it is more easily engaged/aligned as the two sleeves 1002, 1004 are pulled together by the two-sided rotational torque applied to the clutches of the illustrated shear pin 1000 of FIG. 10B. FIGS. 10C-D are perspective views of the teethed ends 1020 of the respective first and second sleeves 1002, 1004 of the embodiment of FIG. 10A-B.

Figures 11A, 11B, 11C, 11D:
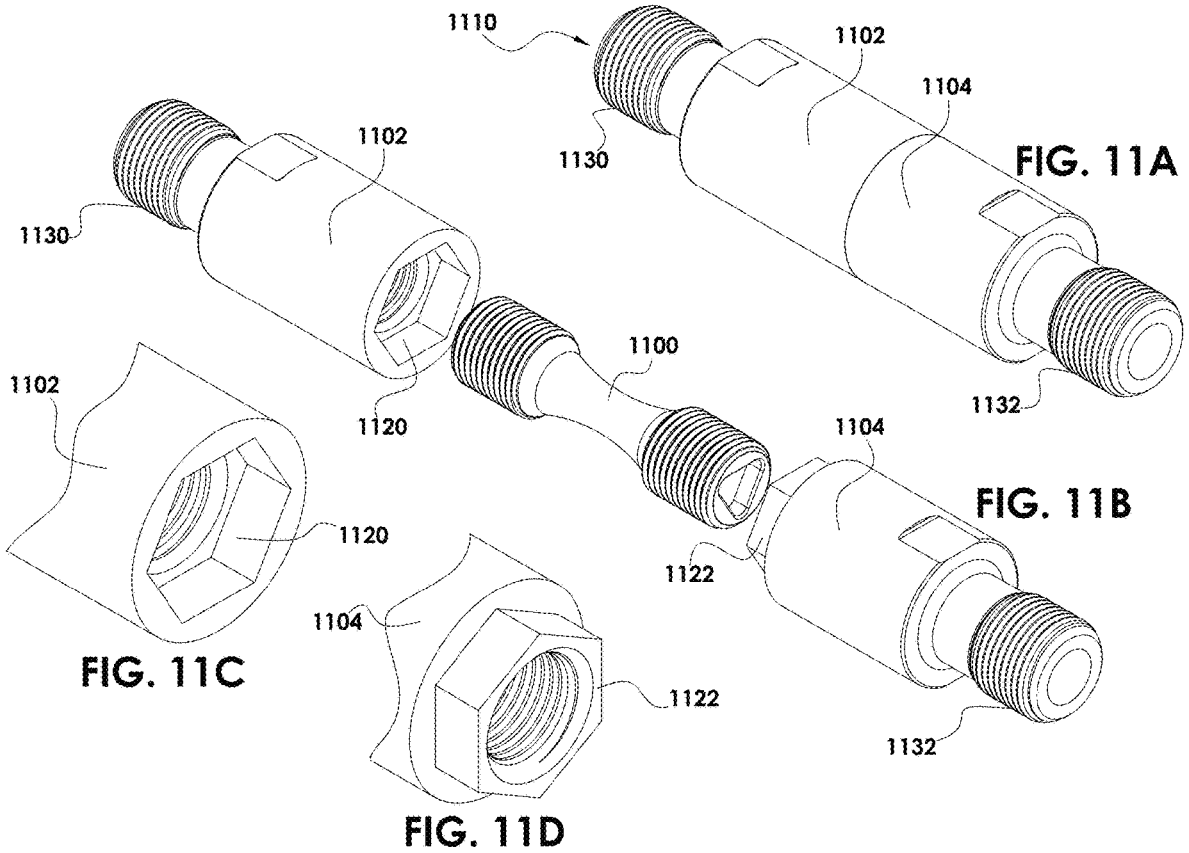
FIG. 11A is a perspective view of an embodiment shear coupling where the two engaging sleeves have an inner-engaging female/male hex form.
FIG. 11B is a perspective exploded view of the FIG. 11A embodiment.
FIGS. 11C-D are perspective views of the teethed ends of the respective first and second sleeves of the embodiment of FIG. 11A.

FIG. 11A is a perspective view of an embodiment shear coupling 1110 where the two engaging sleeves 1102, 1104 have, in lieu of the engaging teeth described in the various embodiments of FIGS. 3-10, inner-engaging female/male hex locking engagements 1120, 1122. This embodiment also differs from the prior described embodiments in that it has outer threads 1130, 1132 for engaging with a rod string 23, rather than the inner threads 70 illustrated in the previous embodiments. Even though the ends of this shear coupling 1110 has outer threads 1130, 1132, it also has openings 1140 in the distal ends of its sleeves 1102, 1104 through which a wrench or other fitting is inserted to apply substantially equal torques to the clutches 1180 on both ends of the shear pin 1100. A first sleeve lower end may include a protruding hex locking engagement 1120 at a point along a vertical axis that is furthest from the first sleeve upper end and extending out of the first sleeve lower end in a direction away from the first sleeve upper end. The second sleeve upper end may include a recessing hex locking engagement at a point along the vertical axis that is furthest away from the second sleeve lower end and recessing into the second sleeve upper end in a direction towards the second sleeve lower end. A protruding hex locking engagement and a recessing hex locking engagement may secure a first sleeve and a second sleeve from a relative rotational movement. In some embodiments, a first sleeve lower end may include a recessing locking engagement and a second sleeve upper end may include a protruding hex locking engagement. A recessing hex locking engagement of a first sleeve lower end and a protruding hex locking engagement of a second sleeve upper end may secure a first sleeve and a second sleeve from a relative rotational movement.

FIG. 11B is a perspective exploded view of the FIG. 11A embodiment, illustrating the shear pin 1100 and the clutch 1180 at one end of the shear pin 1100. Although the figure does not show the clutch 1180 at the second end due to the perspective view, it is understood that, as taught elsewhere in this specification, the clutch 1180 can be at both ends of the shear pin 1100 so that substantially equal torques can be applied at both ends of the shear pin 1100 to achieve the advantageous two-sided assembly into a shear coupling as previously described.

FIGS. 11C-D are perspective views of the female and male engagements 1120 and 1122 of the first and second sleeves 1102, 1104.

Figure 12A:
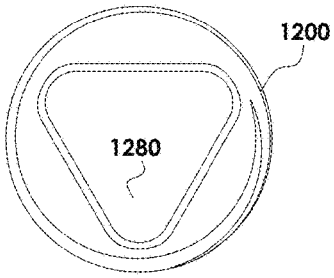
FIG. 12A is an end view showing an end of an embodiment shear pin where a triangular clutch is providing for engaging with a wrench to pre-load the shear pin in the shear coupling.

FIG. 12A is an end view showing an end of an embodiment shear pin 1200 where a triangular clutch 1280 is providing for engaging with a wrench to pre-tension the shear pin 1200 in a shear coupling. This clutch 1280 is understood to be on both sides of the shear pin 1200 in embodiments so that substantially equal torques can be applied at both ends of the shear pin 1200 to achieve the advantageous two-sided assembly previously described.

Figure 12B:
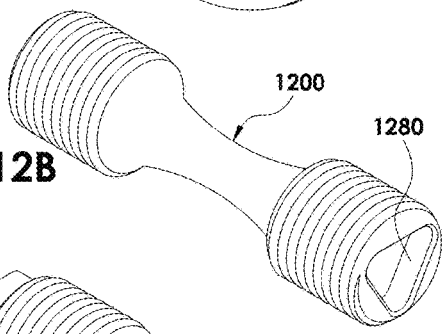
FIG. 12B is a perspective view of the FIG. 12A embodiment.
Figure 12C:
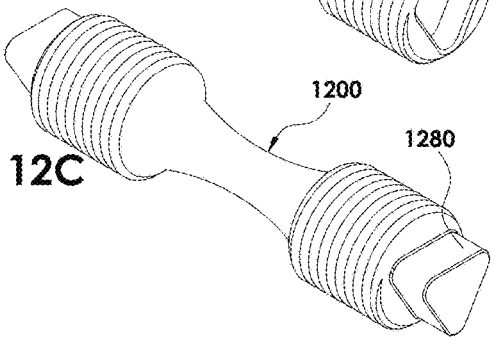
FIG. 12C is a perspective view of an embodiment shear pin where the triangular clutch has a male engagement rather than having the female engagement shown in FIG. 12B.

FIG. 12B is a perspective view of shear pin 1200 of the FIG. 12A embodiment, and FIG. 12C is a perspective view of an embodiment shear pin 1200 where the triangular clutch 1280 has a male engagement rather than having the female engagement shown in FIG. 12B.

Figure 13A:
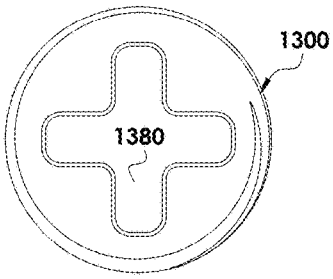
FIG. 13A is an end view showing an end of an embodiment shear pin where a cross-shaped clutch is providing for engaging with a wrench to pre-load the shear pin in the shear coupling.

FIG. 13A is an end view showing an end of an embodiment shear pin 1300 where a cross-shaped clutch 1380 is providing for engaging with a wrench to pre-tension the shear pin 1300 in a shear coupling. This clutch 1380 is understood to be on both sides of the shear pin 1300 in embodiments so that substantially equal torques can be applied at both ends of the shear pin 1300 to achieve the advantageous two-sided assembly previously described.

Figure 13B:
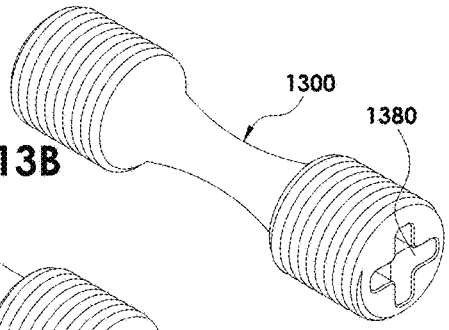
FIG. 13B is a perspective view of the FIG. 13A embodiment.
Figure 13C:
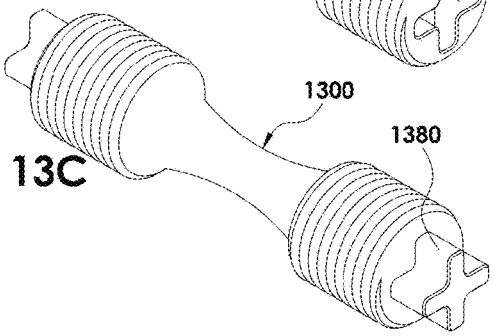
FIG. 13C is a perspective view of an embodiment shear pin where the cross-shaped clutch has a male engagement rather than the female engagement shown in FIG. 13B.

FIG. 13B is a perspective view of shear pin 1300 of the FIG. 13A embodiment, and FIG. 13C is a perspective view of an embodiment shear pin 1300 where the cross-shaped clutch 1380 has a male engagement rather than having the female engagement shown in FIG. 13B.

Figure 14A:
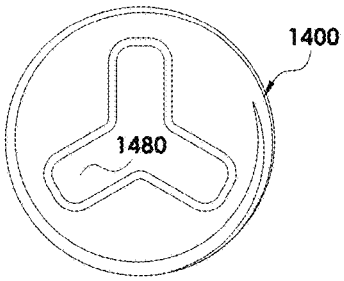
FIG. 14A is an end view showing an end of an embodiment shear pin where a three-arm shaped clutch is providing for engaging with a wrench to pre-load the shear pin in the shear coupling.

FIG. 14A is an end view showing an end of an embodiment shear pin 1400 where a three-arm-shaped clutch 1480 is providing for engaging with a wrench to pre-tension the shear pin 1400 in a shear coupling. This clutch 1480 is understood to be on both sides of the shear pin 1400 in embodiments so that substantially equal torques can be applied at both ends of the shear pin 1400 to achieve the advantageous two-sided assembly previously described.

Figure 14B:
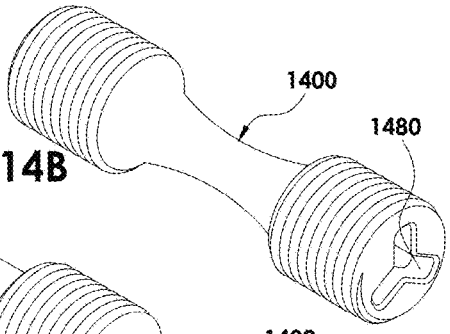
FIG. 14B is a perspective view of the FIG. 14A embodiment.
Figure 14C:
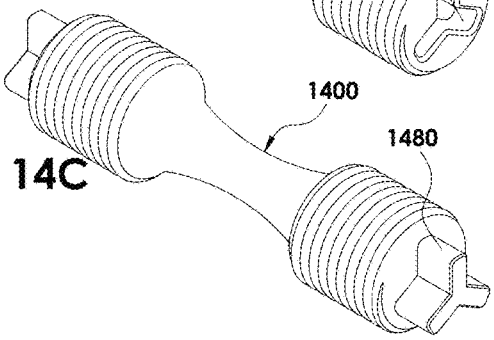
FIG. 14C is a perspective view of an embodiment shear pin where the three-arm-shaped clutch has a male engagement rather than the female engagement shown in FIG. 14B.

FIG. 14B is a perspective view of shear pin 1400 of the FIG. 14A embodiment, and FIG. 14C is a perspective view of an embodiment shear pin 1400 where the three-arm-shaped clutch 1480 has a male engagement rather than having the female engagement shown in FIG. 14B.

Figure 15A:
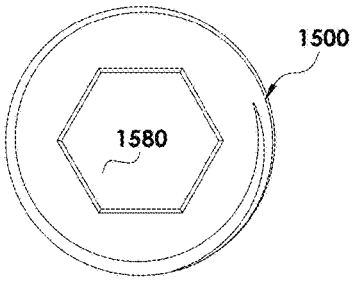
FIGS. 15A-15C are views of shear pin embodiment having a hex-shaped clutch.
Figure 15B:
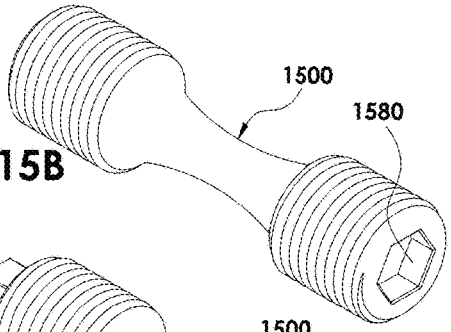
Figure 15C:
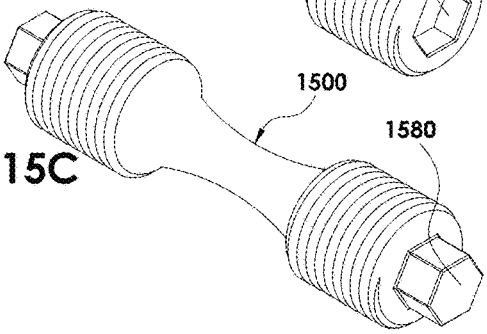

FIG. 15A is an end view showing an end of an embodiment shear pin 1500 where a hex-shaped clutch 1580 is providing for engaging with a wrench to pre-tension the shear pin 1500 in a shear coupling. This clutch 1580 is understood to be on both sides of the shear pin 1500 in embodiments so that substantially equal torques can be applied at both ends of the shear pin 1500 to achieve the advantageous two-sided assembly previously described. Disclosed clutch 1580 may comprise a number of flat sections equal to 6 as in a regular polygonal (equiangular and equilateral) array as illustrated in FIGS. 15A-C. Further, the number of flat sections may be higher or lesser than 6, and the flats may be in an equilateral and equiangular array, or in a non-equilateral and/or non-equiangular array.

FIG. 15B is a perspective view of shear pin 1500 of the FIG. 15B embodiment, and FIG. 15C is a perspective view of an embodiment shear pin 1500 where the hex-shaped clutch 1580 has a male engagement rather than having the female engagement shown in FIG. 15B.

Figure 16A:
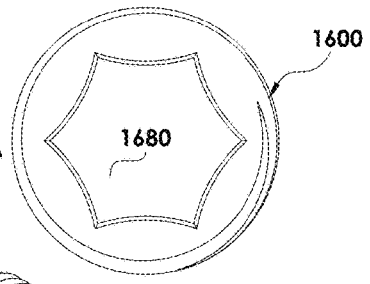
FIGS. 16A-16C are views of shear pin embodiment having a hex-shaped clutch.
Figure 16B:
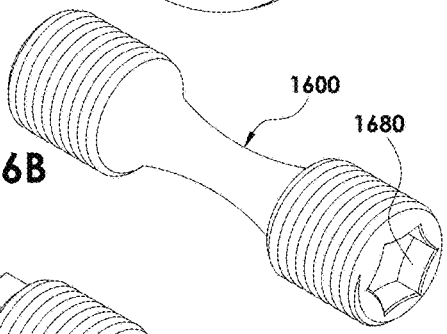
Figure 16C:
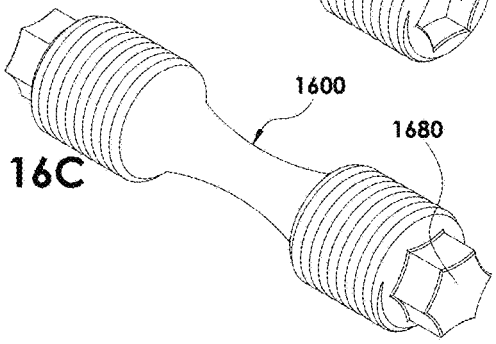

FIG. 16A is an end view showing an end of an embodiment shear pin 1600 where a star-shaped clutch 1680 is providing for engaging with a wrench to pre-tension the shear pin 1600 in a shear coupling. This clutch 1680 is understood to be on both sides of the shear pin 1600 in embodiments so that substantially equal torques can be applied at both ends of the shear pin 1600 to achieve the advantageous two-sided assembly previously described. Disclosed clutch 1680 may comprise a number of sections equal to 6 as illustrated in FIG. 16A-C, or number of sections higher than 6, or a number of sections lower than 6. Described sections of the star-shaped closed-polygonal clutch may be symmetrically distributed around the shear pin longitudinal axis, or may be arranged in a non-symmetrical fashion. Further, the sections of the star-shaped clutch 1680 may be concave or convex, or a combination of both.

FIG. 16B is a perspective view of shear pin 1600 of the FIG. 16B embodiment, and FIG. 16C is a perspective view of an embodiment shear pin 1600 where the star-shaped clutch 1680 has a male engagement rather than having the female engagement shown in FIG. 16B.

A shear pin 1600 may include a first clutch and a second clutch that may each contain one of a triangular-shaped cross-section, a cross-shaped cross-section, a three-arm-shaped cross-section, a hex-shaped cross-section, a star-shaped cross-section, a square-shaped cross-section, and a polygon-shaped cross-section. In some embodiments, a shear pin 1600 may include a first clutch and a second clutch that may each include one of a protruding shape and a recessing shape.

Figure 17A:
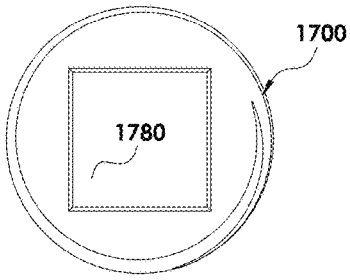
FIGS. 17A-17C are views of shear pin embodiment having a square-shaped clutch.

FIG. 17A is an end view showing an end of an embodiment shear pin 1700 where a square-shaped clutch 1780 is providing for engaging with a wrench to pre-tension the shear pin 1700 in a shear coupling. This clutch 1780 is understood to be on both sides of the shear pin 1700 in embodiments so that substantially equal torques can be applied at both ends of the shear pin 1700 to achieve the advantageous two-sided assembly previously described.

Figure 17B:
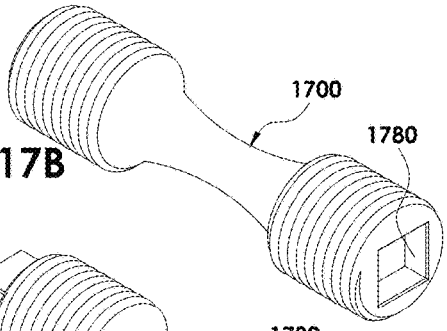
Figure 17C:
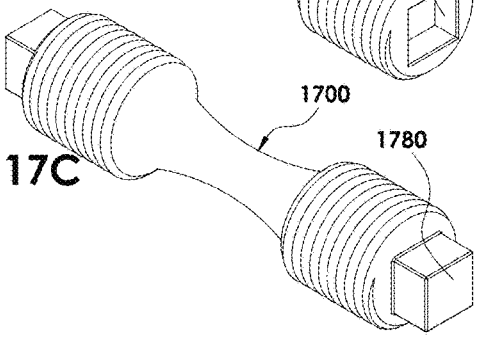

FIG. 17B is a perspective view of shear pin 1700 of the FIG. 17B embodiment, and FIG. 17C is a perspective view of an embodiment shear pin 1700 where the hex-shaped clutch 1780 has a male engagement rather than having the female engagement shown in FIG. 17B.

Disclosed shear pins may incorporate anyone of the clutching features exemplified in FIGS. 12 to 17, a combination of two or more of the clutching features exemplified in FIGS. 12 to 17, or a different clutch profile. In general terms, disclosed shear pins may have prongs or sockets clutching features in the shape of a single or multiple closed polygonal profiles, of regular or non-regular polygonal geometry, with straight or curved sides, so as to provide a mean for transmitting torque to the shear pin.

Figure 18:
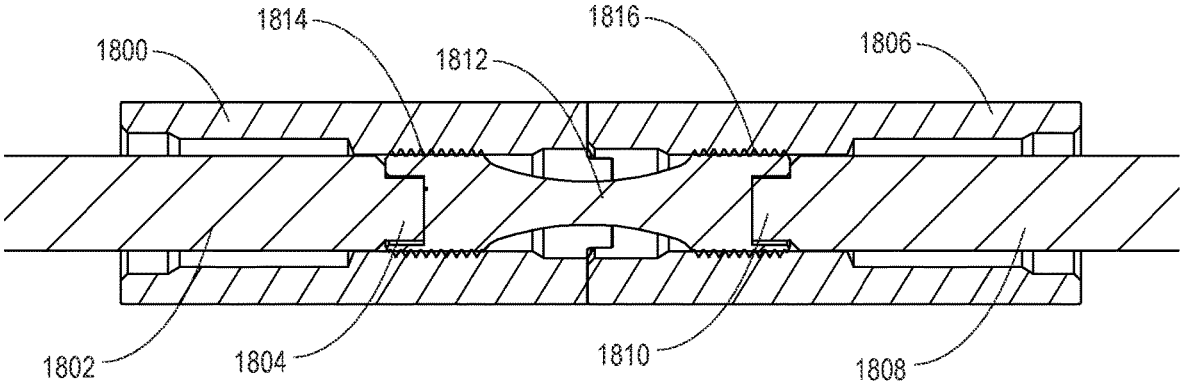
FIG. 18 is a cross-sectional view of an assembly for assembling a shear pin according to an embodiment of the disclosure.

As shown in FIG. 18, the present disclosure relates to methods for assembling shear couplings configured to provide a point of failure for a sucker rod string. A method includes securing a first sleeve 1800 to a first non-rotating shaft 1802 by passing the first non-rotating shaft 1802 through a hollow body of the first sleeve 1800 until a first mechanical coupler 1804 of the first non-rotating shaft 1802 is exposed through an end of the first sleeve 1800. A method for assembling shear couplings may include securing a second sleeve 1806 to a second non-rotating shaft 1808 by passing the second non-rotating shaft 1808 through a hollow body of the second sleeve 1806 until a second mechanical coupler 1810 of the second non-rotating shaft 1808 is exposed through an end of the second sleeve 1806, wherein the first sleeve 1800, the first non-rotating shaft 1802, the second sleeve 1806, and the second rotating shaft 1808 are all aligned along a horizontal axis. Assembling shear couplings may include coupling a first end of a shear pin 1812 to the first mechanical coupler 1804 of the first non-rotating shaft 1802, wherein the first end of the shear pin 1812 comprises a set of first threads 1814 on an outer circumference of the first end, and wherein the first threads 1814 have a first handedness configured to threadably connect within the shear coupling. A method for assembling shear couplings may include coupling a second end of the shear pin 1812 to the second mechanical coupler 1810 of the second non-rotating shaft 1808, wherein the second end of the shear pin 1812 comprises a set of second threads 1816 on an outer circumference of the second end having an opposite handedness from the set of first threads and configured to threadably connect within the shear coupling. Assembling a shear coupling may include applying a thread locker on a surface of each of the set of first threads and set of second threads and rotating the first sleeve about the horizontal axis so that the first set of threads is threaded inside the first sleeve while rotating the second sleeve about the horizontal axis so that the second set of threads is threaded inside the second sleeve until the first sleeve and the second sleeve meet at a center point along a horizontal axis of the shear pin, thereby forming an assembled shear coupling.

In some embodiments, assembling a shear coupling may include engaging teeth of a first sleeve with teeth of a second sleeve, thereby securing the first sleeve and the second sleeve from relative rotational movement. Teeth on each of the first sleeve and the second sleeve may be oriented toward each other. Assembling a shear coupling may include positioning a wrench on a flat on each of the first sleeve and a second sleeve, adjusting an orientation of a head on the wrench until a bar of the wrench is aligned with the horizontal axis, and applying a first low preload torque of about 10% to about 20% of a shear pin yield stress strength on the bar of the wrench until the wrench makes a clicking sound.

In some embodiments, a method for assembling a shear coupling may include releasing a first torque on the bar without removing the wrench; applying a second preload torque of about 70% of the shear pin yield stress strength on the bar of the wrench and removing the shear coupling from each of the first non-rotating shaft and the second non-rotating shaft.

The above embodiments are described as specific embodiments and should not be used to limit the scope of the claims, although it should be appreciated that there are synergies in providing a combination of claimed features as disclosed in the embodiments of this specification. For example, use of the disclosed and/or claimed stress-zone designs can be synergistically combined with two-sided assembly structures and techniques disclosed herein to minimize or eliminate torque assembly damages, voids, and/or discontinuities in metallurgical properties. The synergistic combination of these elements further provides for a finally assembled shear coupling that has a higher pre-load applied and that provides for better thread engaging of the shear coupling with the other elements of a rod string and provides for an improved shear coupling that is less susceptible to operational fatigue.

Where the verb "may" appears, it is intended to convey an optional and/or permissive condition, but its use is not intended to suggest any lack of operability unless otherwise indicated. Where open terms such as "having" or "comprising" are used, one of ordinary skill in the art having the benefit of the instant disclosure will appreciate that the disclosed features or steps optionally may be combined with additional features or steps. Such option may not be exercised and, indeed, in some embodiments, disclosed systems, compositions, apparatuses, and/or methods may exclude any other features or steps beyond those disclosed herein. Persons skilled in the art may make various changes in the systems of the disclosure.

Also, where ranges have been provided, the disclosed endpoints may be treated as exact and/or approximations as desired or demanded by the particular embodiment. Where the endpoints are approximate, the degree of flexibility may vary in proportion to the order of magnitude of the range. For example, on one hand, a range endpoint of about 50 in the context of a range of about 5 to about 50 may include 50.5, but not 52.5 or 55 and, on the other hand, a range endpoint of about 50 in the context of a range of about 0.5 to about 50 may include 55, but not 60 or 75. In addition, it may be desirable, in some embodiments, to mix and match range endpoints. Also, in some embodiments, each figure disclosed (e.g., in one or more of the examples, tables, and/or drawings) may form the basis of a range (e.g., depicted value +/− about 10%, depicted value +/− about 50%, depicted value +/− about 100%) and/or a range endpoint. With respect to the former, a value of 50 depicted in an example, table, and/or drawing may form the basis of a range of, for example, about 45 to about 55, about 25 to about 100, and/or about 0 to about 100. Disclosed percentages are weight percentages except where indicated otherwise.

All or a portion of a device and/or system for rod string shear couplings may be configured and arranged to be disposable, serviceable, interchangeable, and/or replaceable. These equivalents and alternatives along with obvious changes and modifications are intended to be included within the scope of the present disclosure. Accordingly, the foregoing disclosure is intended to be illustrative, but not limiting, of the scope of the disclosure.

What is claimed is:

1. A shear pin configured to threadably connect within a shear coupling and to provide a point of failure for a sucker rod string, the shear pin comprising:

(a) a cylindrical shape positioned along a vertical axis having a first end positioned at a top of the vertical axis and a second end positioned at a bottom of the vertical axis and having a curved portion connecting the first end to the second end;

(b) the first end having a common diameter with the second end and comprising:

(i) a set of first threads on an outer circumference of the first end, the set of first threads having a first handedness and configured to threadably connect within the shear coupling; and (ii) a first clutch at a point along the vertical axis that is furthest from the second end, the first clutch comprising one of a recessing shape or a protruding shape;

(c) the second end comprising:

(i) a set of second threads on an outer circumference of the second end, the set of second threads having an opposite handedness from the set of first threads and configured to threadably connect within the shear coupling; and (ii) a second clutch at a point along the vertical axis that is furthest from the first end, the second clutch comprising one of a recessing shape or a protruding shape; and (d) the curved portion comprising a diameter that is largest where the curved portion connects to each of the first end and the second end and then narrows along the curved portion, forming a curve that culminates at a neck where the diameter is smallest, wherein a ratio of a curvature radius of the curve to the diameter of the neck ranges from 2 to 10.

2. The shear pin according to claim 1, wherein at least one of:

the diameter of the neck ranges from 0.25 inches to 1.25 inches, the shear pin has a stress safety factor of lower than 1.10, or a rupture load of the shear pin ranges from 5,000 pounds to 70,000 pounds.

3. The shear pin according to claim 1, wherein at least one of:

the recessing shape of the first clutch comprises one of a triangular-shaped cross-section, a cross-shaped cross-section, a three-arm-shaped cross-section, a hex-shaped cross-section, a star-shaped cross-section, a square-shaped cross-section, or a polygon-shaped cross-section, the protruding shape of the first clutch comprises one of a triangular-shaped cross-section, a cross-shaped cross-section, a three-arm-shaped cross-section, a hex-shaped cross-section, a star-shaped cross-section, a square-shaped cross-section, or a polygon-shaped cross-section, the recessing shape of the second clutch comprises one of a triangular-shaped cross-section, a cross-shaped cross-section, a three-arm-shaped cross-section, a hex-shaped cross-section, a star-shaped cross-section, a square-shaped cross-section, or a polygon shaped-cross-section, or the protruding shape of the second clutch comprises one of a triangular-shaped cross-section, a cross-shaped cross-section, a three-arm-shaped cross-section, a hex-shaped cross-section, a star-shaped cross-section, a square-shaped cross-section, or a polygon-shaped cross-section.

4. The shear pin according to claim 1, wherein one of:

the first clutch has the protruding shape and the second clutch has the protruding shape, the first clutch has the recessing shape and the second clutch has the protruding shape, the first clutch has the protruding shape and the second clutch has the recessing shape, or the first clutch has the recessing shape and the second clutch has the recessing shape.

5. A shear pin configured to threadably connect within a shear coupling and to provide a point of failure for a sucker rod string, the shear pin comprising:

(a) a cylindrical shape positioned along a vertical axis having a first end positioned at a top of the vertical axis and a second end positioned at a bottom of the vertical axis and having a curved portion connecting the first end to the second end;

(b) the first end having a common diameter with the second end and comprising:

(i) a set of first threads on an outer circumference of the first end, the set of first threads having a first handedness and configured to threadably connect within the shear coupling; and (ii) a first clutch at a point along the vertical axis that is furthest from the second end, the first clutch comprising one of a recessing shape or a protruding shape;

(c) the second end comprising a set of second threads on an outer circumference of the second end, the set of second threads having an opposite handedness from the set of first threads and configured to threadably connect within the shear coupling; and (d) the curved portion comprising a diameter that is largest where the curved portion connects to each of the first end and the second end and then narrows along the curved portion, forming a curve that culminates at a neck where the diameter is smallest, wherein a ratio of a curvature radius of the curve to the diameter of the neck ranges from 2 to 10.

6. The shear pin according to claim 5, wherein at least one of:

the shear pin has a stress safety factor of lower than 1.10, the shear pin has a rupture load ranging from 5,000 pounds to 70,000 pounds, the recessing shape of the first clutch comprises one of a triangular-shaped cross-section, a cross-shaped cross-section, a three-arm-shaped cross-section, a hex-shaped cross-section, a star-shaped cross-section, a square-shaped cross-section, or a polygon-shaped cross-section, or the protruding shape of the first clutch comprises one of a triangular-shaped cross-section, a cross-shaped cross-section, a three-arm-shaped cross-section, a hex-shaped cross-section, a star-shaped cross-section, a square-shaped cross-section, or a polygon-shaped cross-section.

7. The shear pin according to claim 5, wherein the second end further comprises a second clutch at a point along the vertical axis that is furthest from the first end, the second clutch comprising one of a recessing shape or a protruding shape, and wherein at least one of the recessing shape or the protruding shape of the second clutch comprises one of a triangular-shaped cross-section, a cross-shaped cross-section, a three-arm-shaped cross-section, a hex-shaped cross-section, a star-shaped cross-section, a square-shaped cross-section, or a polygon-shaped cross-section.

8. A shear coupling configured to provide a point of failure for a sucker rod string, the shear coupling comprising:

(a) a first sleeve comprising a substantially cylindrical and hollow body, the first sleeve further comprising:

(i) a first sleeve upper end comprising threads around an inner circumference of the first sleeve upper end, the first sleeve configured to internally receive and threadably couple to a sucker rod, and (ii) a first sleeve lower end connected to the first sleeve upper end through a first sleeve body, the first sleeve lower end comprising threads around an inner circumference of the first sleeve lower end that are separated from the threads of the first sleeve upper end by a gap and configured to internally receive and threadably couple to a shear pin; and (b) the shear pin comprising:

(i) a cylindrical shape positioned along a vertical axis having a first end positioned at a top of the vertical axis and a second end positioned at a bottom of the vertical axis and having a curved portion connecting the first end to the second end, (ii) the first end having a common diameter with the second end and comprising:

a set of first threads on an outer circumference of the first end, the set of first threads having a first handedness and configured to threadably connect within the shear coupling, and a first clutch at a point along the vertical axis that is furthest from the second end, the first clutch comprising one of a recessing shape or a protruding shape, (iii) the second end comprising:

a set of second threads on an outer circumference of the second end, the set of second threads having an opposite handedness from the set of first threads and configured to threadably connect within the shear coupling, and a second clutch at a point along the vertical axis that is furthest from the first end, the second clutch comprising one of a recessing shape or a protruding shape, and (iv) the curved portion comprising a diameter that is largest where the curved portion connects to each of the first end and the second end and then narrows along the curved portion, forming a curve that culminates at a neck where the diameter is smallest, a ratio of a curvature radius of the curve to the diameter of the neck ranges from 2 to 10.

9. The shear coupling according to claim 8, wherein the diameter of the neck ranges from 0.25 inches to 1.25 inches.

10. The shear coupling according to claim 8, wherein at least one of:

the shear pin has a stress safety factor of lower than 1.10, or the shear pin has a rupture load ranging from 5,000 pounds to 70,000 pounds.

11. The shear coupling according to claim 8, wherein one of:

the first clutch has the protruding shape and the second clutch has the protruding shape, the first clutch has the recessing shape and the second clutch has the protruding shape, the first clutch has the protruding shape and the second clutch has the recessing shape, or the first clutch has the recessing shape and the second clutch has the recessing shape.

12. The shear coupling according to claim 8, further comprising:

(c) a second sleeve comprising a substantially cylindrical and hollow body, the second sleeve further comprising:

(i) a second sleeve lower end comprising threads around an inner circumference of the second sleeve lower end, the second sleeve configured to internally receive and threadably couple to a sucker rod, and (ii) a second sleeve upper end connected to the second sleeve lower end through a second sleeve body, the second sleeve upper end comprising threads around an inner circumference of the second sleeve upper end that are separated from the threads of the second sleeve lower end by a gap and configured to internally receive and threadably couple to the shear pin.

13. The shear coupling according to claim 12, further comprising:

(d) a chamber located in between an inner surface of each of the hollow bodies of the first sleeve and the second sleeve and an outer surface of the shear pin, wherein the hollow chamber is filled with one of an epoxy, a corrosive resistant thermoset single polymer, and a corrosive resistant thermoset cross linked polymer.

14. The shear coupling according to claim 12, wherein the first sleeve lower end further comprises teeth at a point along the vertical axis that is furthest from the first sleeve upper end and extending away from the first sleeve upper end, wherein the second sleeve upper end further comprises teeth at a point along the vertical axis that is furthest from the second sleeve lower end and extending away from the second sleeve lower end, and wherein the teeth of the first sleeve lower end are configured to engage the teeth of the second sleeve upper end and secure the first sleeve and the second sleeve from relative rotational movement, wherein the teeth are further configured to provide for a rupture torque of the shear coupling that ranges from 500 foot-pounds to 5000 foot-pounds.

15. The shear coupling according to claim 12, wherein one of:

the first sleeve lower end further comprises a protruding hex locking engagement at a point along the vertical axis that is furthest from the first sleeve upper end and extending out of the first sleeve lower end in a direction away from the first sleeve upper end, wherein the second sleeve upper end further comprises a recessing hex locking engagement at a point along the vertical axis that is furthest away from the second sleeve lower end and recessing into the second sleeve upper end in a direction towards the second sleeve lower end, and wherein the protruding hex locking engagement and the recessing hex locking engagement secure the first sleeve and the second sleeve from relative rotational movement; or the first sleeve lower end further comprises a recessing hex locking engagement at a point along the vertical axis that is furthest from the first sleeve upper end and recessing into the first sleeve lower end in a direction towards the first sleeve upper end, where the second sleeve upper end further comprises a protruding hex locking engagement at a point along the vertical axis that is furthest away from the second sleeve lower end and protruding away from the second sleeve lower end in a direction away from the second sleeve lower end, and wherein the recessing hex locking engagement and the protruding hex locking engagement secure the first sleeve and the second sleeve from relative rotational movement.

16. The shear coupling according to claim 8, wherein at least one of:

the recessing shape of the first clutch comprises one of a triangular-shaped cross-section, a cross-shaped cross-section, a three-arm-shaped cross-section, a hex-shaped cross-section, a star-shaped cross-section, a square-shaped cross-section, or a polygon-shaped cross-section;

the protruding shape of the first clutch comprises one of a triangular-shaped cross-section, a cross-shaped cross-section, a three-arm-shaped cross-section, a hex-shaped cross-section, a star-shaped cross-section, a square-shaped cross-section, or a polygon-shaped cross-section;

the recessing shape of the second clutch comprises one of a triangular-shaped cross-section, a cross-shaped cross-section, a three-arm-shaped cross-section, a hex-shaped cross-section, a star-shaped cross-section, a square-shaped cross-section, or a polygon-shaped cross-section; or the protruding shape of the second clutch comprises one of a triangular-shaped cross-section, a cross-shaped cross-section, a three-arm-shaped cross-section, a hex-shaped cross-section, a star-shaped cross-section, a square-shaped cross-section, or a polygon-shaped cross-section.

17. A method for assembling a shear coupling configured to provide a point of failure for a sucker rod string, the method comprising:

(a) passing a first sleeve over a first non-rotating shaft by extending the first non-rotating shaft through a hollow body of the first sleeve until a first mechanical coupler of the first non-rotating shaft is exposed through an end of the first sleeve;

(b) passing a second sleeve over a second non-rotating shaft by extending the second non-rotating shaft through a hollow body of the second sleeve until a second mechanical coupler of the second non-rotating shaft is exposed through an end of the second sleeve, wherein the first sleeve, the first non-rotating shaft, the second sleeve, and the second non-rotating shaft are all aligned along a horizontal axis;

(c) engaging a first end of a shear pin with the first mechanical coupler of the first non-rotating shaft, wherein the shear pin comprises a set of first threads on an outer circumference of the shear pin proximate the first end, and wherein the set of first threads have a first handedness configured to threadably connect within the shear coupling;

(d) engaging a second end of the shear pin with the second mechanical coupler of the second non-rotating shaft, wherein the shear pin comprises a set of second threads on an outer circumference of the shear pin proximate the second end having an opposite handedness from the set of first threads and configured to threadably connect within the shear coupling;

(e) applying a thread locker on a surface of each of the set of first threads and set of second threads;

(f) rotating the first sleeve about an axis so that the set of first threads is threaded inside the first sleeve while rotating the second sleeve about the axis so that the set of second threads is threaded inside the second sleeve until the first sleeve and the second sleeve meet at a center point along the shear pin, thereby forming an assembled shear coupling, the rotating comprising:

positioning a wrench on a flat on each of the first sleeve and a second sleeve;

adjusting an orientation of a head on the wrench until a bar of the wrench is aligned with the axis;

applying a first low preload torque of 10% to 20% of a shear pin yield stress strength on the bar of the wrench until the wrench makes a clicking sound; and (g) engaging teeth of the first sleeve with teeth of the second sleeve, thereby securing the first sleeve and the second sleeve from relative rotational movement, wherein the teeth on each of the first sleeve and the second sleeve are oriented toward each other.

18. The method for assembling the shear coupling according to claim 17, further comprising engaging the teeth of the first sleeve that are positioned on an axial end of the first sleeve with the teeth of the second sleeve that are positioned on an axial end of the second sleeve.

19. The method for assembling the shear coupling according to claim 17, further comprising:

releasing the first torque on the bar without removing the wrench;

applying a second preload torque of 70% of the shear pin yield stress strength on the bar of the wrench; and removing the shear coupling from each of the first sleeve and the second sleeve.

20. The method for assembling the shear coupling according to claim 19, wherein the first sleeve and the second sleeve each comprise a perforation on each of their respective ends that are oriented toward each other, wherein the shear coupling comprises a hollow chamber located in between an inner surface of each of the hollow bodies of the first sleeve and the second sleeve and an outer surface of the shear pin, and wherein the method further comprises applying a polymer to at least one perforation of the first sleeve and the second sleeve, thereby filling the hollow chamber to form a polymer filled chamber comprising the applied polymer, wherein the polymer comprises an epoxy, a corrosive resistant thermoset single polymer, and a corrosive resistant thermoset cross linked polymer.

21. A method for assembling a shear coupling configured to provide a point of failure for a sucker rod string, the method comprising:

passing a first sleeve over a first non-rotating shaft by extending the first non-rotating shaft through a hollow body of the first sleeve until a first mechanical coupler of the first non-rotating shaft is exposed through an end of the first sleeve;

passing a second sleeve over a second non-rotating shaft by extending the second non-rotating shaft through a hollow body of the second sleeve until a second mechanical coupler of the second non-rotating shaft is exposed through an end of the second sleeve, wherein the first sleeve, the first non-rotating shaft, the second sleeve, and the second non-rotating shaft are all aligned along a horizontal axis;

engaging a first end of a shear pin with the first mechanical coupler of the first non-rotating shaft, wherein the shear pin comprises a set of first threads on an outer circumference of the shear pin proximate the first end, and wherein the set of first threads have a first handedness configured to threadably connect within the shear coupling;

engaging a second end of the shear pin with the second mechanical coupler of the second non-rotating shaft, wherein the shear pin comprises a set of second threads on an outer circumference of the shear pin proximate the second end having an opposite handedness from the set of first threads and configured to threadably connect within the shear coupling;

applying a thread locker on a surface of each of the set of first threads and set of second threads;

rotating the first sleeve about an axis so that the set of first threads is threaded inside the first sleeve while rotating the second sleeve about the axis so that the set of second threads is threaded inside the second sleeve until the first sleeve and the second sleeve meet at a center point along the shear pin, thereby forming an assembled shear coupling, the rotating comprising applying a first low preload torque of 10% to 20% of a shear pin yield stress strength on the assembled shear coupling; and engaging teeth of the first sleeve with teeth of the second sleeve, thereby securing the first sleeve and the second sleeve from relative rotational movement, wherein the teeth on each of the first sleeve and the second sleeve are oriented toward each other.

* * * * *